US011796961B2

(12) United States Patent
Ely et al.

(10) Patent No.: US 11,796,961 B2
(45) **Date of Patent: *Oct. 24, 2023**

(54) CONDUCTIVE CAP FOR WATCH CROWN

(71) Applicant: Apple Inc., Cupertino, CA (US)

(72) Inventors: Colin M. Ely, Sunnyvale, CA (US); Sameer Pandya, Sunnyvale, CA (US); Steven C. Roach, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/507,381

(22) Filed: Oct. 21, 2021

(65) Prior Publication Data

US 2022/0043397 A1 Feb. 10, 2022

Related U.S. Application Data

(63) Continuation of application No. 16/221,549, filed on Dec. 16, 2018, now Pat. No. 11,181,863.

(Continued)

(51) Int. Cl.

*G04B 3/04* (2006.01)
*G04C 3/00* (2006.01)

(Continued)

(52) U.S. Cl.

CPC ..... *G04B 3/046* (2013.01); *G04C 3/001* (2013.01); *G04G 17/045* (2013.01); *G04G 17/06* (2013.01);

(Continued)

(58) Field of Classification Search

CPC .... G04G 21/025; G04G 17/045; G04G 17/06; G04G 21/08; G04G 17/08; G04B 3/046;

(Continued)

(56) References Cited

U.S. PATENT DOCUMENTS 2,237,860 A 4/1941 Bolle
2,288,215 A 6/1942 Taubert et al.

(Continued)

FOREIGN PATENT DOCUMENTS

CH 1888928 1/1937
CN 1302740 9/2001

(Continued)

OTHER PUBLICATIONS

Author Unknown, "Desirable Android Wear smartwatch from LG," Gulf News, Dubai, 3 pages, Jan. 30, 2015.

(Continued)

*Primary Examiner* — Edwin A. Leon

(74) *Attorney, Agent, or Firm* — Brownstein Hyatt Farber Schreck, LLP

(57) ABSTRACT

An electronic device, such as a watch, has a crown assembly having a shaft and a user-rotatable crown. The user-rotatable crown may include a conductive cap that is mechanically and electrically coupled to the shaft and functions as an electrode. The conductive cap may be coupled to the shaft using solder or another conductive attachment mechanism. The shaft may electrically couple the conductive cap to a processing unit of the electronic device. One or more additional electrodes may be positioned on the exterior surface of the electronic device. The conductive cap is operable to be contacted by a finger of a user of the electronic device while another electrode is positioned against skin of the user. The processing unit of the electronic device is operable to determine a biological parameter, such as an electrocardiogram, of the user based on voltages at the electrodes.

20 Claims, 17 Drawing Sheets

Related U.S. Application Data

(60) Provisional application No. 62/722,796, filed on Aug. 24, 2018.

(51) Int. Cl.

| | |
|---|---|
| ***G04G 21/02*** | (2010.01) |
| ***G04G 17/06*** | (2006.01) |
| ***G04G 17/08*** | (2006.01) |
| ***G04G 17/04*** | (2006.01) |
| ***G04G 21/08*** | (2010.01) |

(52) U.S. Cl.
CPC ..... *G04G 17/08* (2013.01); *G04G 21/025* (2013.01); *G04G 21/08* (2013.01)

(58) Field of Classification Search
CPC ..... G04C 3/005; G04C 3/001; H01H 3/122; H01H 9/16; H01H 25/008; H01H 2215/006; H01H 2221/01; H01H 25/06; H01H 2209/006; H01H 2223/002
See application file for complete search history.

(56) References Cited

U.S. PATENT DOCUMENTS 2,497,935 A 2/1950 Feurer
2,771,734 A 11/1956 Morf
2,788,236 A 4/1957 Kafowi
2,797,592 A 7/1957 Marrapese
3,040,514 A 6/1962 Dinstman
3,056,030 A 9/1962 Kelchner
3,130,539 A 4/1964 Davis
3,355,873 A 12/1967 Morf
3,362,154 A 1/1968 Perret
3,410,247 A 11/1968 Dronberger
3,495,398 A 2/1970 Widmer et al.
3,577,876 A 5/1971 Spadini
3,621,649 A 11/1971 Vulcan et al.
3,662,618 A 5/1972 Kroll et al.
3,733,803 A 5/1973 Hiraga
3,937,002 A 2/1976 Van Haaften
4,007,347 A 2/1977 Haber
4,031,341 A 6/1977 Wuthrich et al.
4,037,068 A 7/1977 Gaynor
4,051,665 A 10/1977 Arn
4,077,200 A 3/1978 Schneider
4,133,404 A 1/1979 Griffin
4,170,104 A 10/1979 Yamagata
4,258,096 A 3/1981 LaMarche
4,274,152 A 6/1981 Ikegami
4,287,400 A 9/1981 Kitik
4,289,400 A 9/1981 Kubola et al.
4,311,026 A 1/1982 Ochoa
4,311,990 A 1/1982 Burke
4,324,956 A 4/1982 Sakakino et al.
4,345,119 A 8/1982 Latasiewicz
4,364,674 A 12/1982 Tesch
4,379,642 A 4/1983 Meyrat
4,395,134 A 7/1983 Luce
4,396,298 A 8/1983 Ripley
4,417,824 A 11/1983 Paterson et al.
4,448,199 A 5/1984 Schmid
4,520,306 A 5/1985 Kirby
4,581,509 A 4/1986 Sanford et al.
4,600,316 A 7/1986 Besson
4,617,461 A 10/1986 Subbarao et al.
4,634,861 A 1/1987 Ching et al.
4,641,026 A 2/1987 Garcia, Jr.
4,670,737 A 6/1987 Rilling
4,766,642 A 8/1988 Gaffney et al.
4,783,772 A 11/1988 Umemoto et al.
4,884,073 A 11/1989 Souloumiac
4,914,831 A 4/1990 Kanezashi et al.
4,922,070 A 5/1990 Dorkinski
4,931,794 A 6/1990 Haag
4,952,799 A 8/1990 Loewen
4,980,685 A 12/1990 Souloumiac et al.
4,987,299 A 1/1991 Kobayashi et al.
5,034,602 A 7/1991 Garcia et al.
5,177,355 A 1/1993 Branan
5,214,278 A 5/1993 Banda
5,258,592 A 11/1993 Nishikawa et al.
5,288,993 A 2/1994 Bidiville et al.
5,347,123 A 9/1994 Jackson et al.
5,383,166 A 1/1995 Gallay
5,471,054 A 11/1995 Watanabe
5,477,508 A 12/1995 Will
5,509,174 A 4/1996 Worrell
5,559,761 A 9/1996 Frenkel et al.
5,572,314 A 11/1996 Hyman et al.
5,583,560 A 12/1996 Florin et al.
5,631,881 A 5/1997 Pessey et al.
5,726,645 A 3/1998 Kamon et al.
5,738,104 A 4/1998 Lo
5,748,111 A 5/1998 Bates
5,825,353 A 10/1998 Will
5,841,050 A 11/1998 Clift et al.
5,847,335 A 12/1998 Sugahara et al.
5,867,082 A 2/1999 Van Zeeland
5,943,233 A 8/1999 Ebina
5,953,001 A 9/1999 Challener et al.
5,960,366 A 9/1999 Duwaer et al.
5,963,332 A 10/1999 Feldman et al.
5,999,168 A 12/1999 Rosenberg et al.
6,069,567 A 5/2000 Zawilski
6,128,006 A 10/2000 Rosenberg et al.
6,134,189 A 10/2000 Carrard
6,154,201 A 11/2000 Levin et al.
6,175,679 B1 1/2001 Veligdan et al.
6,203,190 B1 3/2001 Stotz
6,241,684 B1 6/2001 Amano
6,246,050 B1 6/2001 Tullis et al.
6,252,825 B1 6/2001 Perotto
6,304,247 B1 10/2001 Black
6,355,891 B1 3/2002 Ikunami
6,361,502 B1 3/2002 Puolakanaho et al.
6,377,239 B1 4/2002 Isikawa
6,392,640 B1 5/2002 Will
6,396,006 B1 5/2002 Yokoji et al.
6,422,740 B1 7/2002 Leuenberger
6,477,117 B1 11/2002 Narayanaswami et al.
6,502,982 B1 1/2003 Bach et al.
6,525,278 B2 2/2003 Villain et al.
6,556,222 B1 4/2003 Narayanaswami
6,575,618 B1 6/2003 Inoue et al.
6,587,400 B1 7/2003 Line
6,636,197 B1 10/2003 Goldenberg et al.
6,646,635 B2 11/2003 Pogatetz et al.
6,661,438 B1 11/2003 Shiraishi et al.
6,672,758 B2 1/2004 Ehrsam et al.
6,794,992 B1 9/2004 Rogers
6,809,275 B1 10/2004 Cheng et al.
6,834,430 B2 12/2004 Worrell
6,846,998 B2 1/2005 Hasumi et al.
6,882,596 B2 4/2005 Guanter
6,888,076 B2 5/2005 Hetherington
6,896,403 B1 5/2005 Gau
6,909,378 B1 6/2005 Lambrechts et al.
6,914,551 B2 7/2005 Vidal
6,961,099 B2 11/2005 Takano et al.
6,963,039 B1 11/2005 Weng et al.
6,967,903 B2 11/2005 Guanter
6,977,868 B2 12/2005 Brewer et al.
6,982,930 B1 1/2006 Hung
6,985,107 B2 1/2006 Anson
6,987,568 B2 1/2006 Dana
6,998,553 B2 2/2006 Hisamune et al.
7,009,915 B2 3/2006 Brewer et al.
7,016,263 B2 3/2006 Gueissaz et al.
7,021,442 B2 4/2006 Borgerson
7,031,228 B2 4/2006 Born et al.
7,034,237 B2 4/2006 Ferri et al.
7,081,905 B1 7/2006 Raghunath et al.
7,102,626 B2 9/2006 Denny, III

(56) References Cited

U.S. PATENT DOCUMENTS

| | | | |
|---|---|---|---|
| 7,111,365 | B1 | 9/2006 | Howie, Jr. |
| 7,113,450 | B2 | 9/2006 | Plancon et al. |
| 7,119,289 | B2 | 10/2006 | Lacroix |
| 7,135,673 | B2 | 11/2006 | Saint Clair |
| 7,167,083 | B2 | 1/2007 | Giles |
| 7,187,359 | B2 | 3/2007 | Numata |
| 7,244,927 | B2 | 7/2007 | Huynh |
| 7,255,473 | B2 | 8/2007 | Hiranuma et al. |
| 7,265,336 | B2 | 9/2007 | Hataguchi et al. |
| 7,274,303 | B2 | 9/2007 | Dresti et al. |
| 7,285,738 | B2 | 10/2007 | Lavigne et al. |
| 7,286,063 | B2 | 10/2007 | Gauthey |
| 7,292,741 | B2 | 11/2007 | Ishiyama et al. |
| 7,358,481 | B2 | 4/2008 | Yeoh et al. |
| 7,369,308 | B2 | 5/2008 | Tsuruta et al. |
| 7,371,745 | B2 | 5/2008 | Ebright et al. |
| 7,385,874 | B2 | 6/2008 | Vuilleumier |
| 7,404,667 | B2 | 7/2008 | Born et al. |
| 7,465,917 | B2 | 12/2008 | Chin et al. |
| 7,468,036 | B1 | 12/2008 | Rulkov et al. |
| 7,506,269 | B2 | 3/2009 | Lang et al. |
| 7,520,664 | B2 | 4/2009 | Wai |
| 7,528,824 | B2 | 5/2009 | Kong |
| 7,545,367 | B2 | 6/2009 | Sunda et al. |
| 7,591,582 | B2 | 9/2009 | Hiranuma et al. |
| 7,593,755 | B2 | 9/2009 | Colando et al. |
| 7,605,846 | B2 | 10/2009 | Watanabe |
| 7,634,263 | B2 | 12/2009 | Louch et al. |
| 7,646,677 | B2 | 1/2010 | Nakamura |
| 7,655,874 | B2 | 2/2010 | Akieda |
| 7,682,070 | B2 | 3/2010 | Burton |
| 7,708,457 | B2 | 5/2010 | Girardin |
| 7,710,456 | B2 | 5/2010 | Koshiba et al. |
| 7,732,724 | B2 | 6/2010 | Otani et al. |
| 7,761,246 | B2 | 7/2010 | Matsui |
| 7,763,819 | B2 | 7/2010 | Ieda et al. |
| 7,772,507 | B2 | 8/2010 | Orr |
| 7,778,115 | B2 | 8/2010 | Ruchonnet |
| 7,781,726 | B2 | 8/2010 | Matsui et al. |
| RE41,637 | E | 9/2010 | O'Hara et al. |
| 7,791,587 | B2 | 9/2010 | Kosugi |
| 7,791,588 | B2 | 9/2010 | Tierling et al. |
| 7,791,597 | B2 | 9/2010 | Silverstein et al. |
| 7,822,469 | B2 | 10/2010 | Lo |
| 7,856,255 | B2 | 12/2010 | Tsuchiya et al. |
| 7,858,583 | B2 | 12/2010 | Schmidt et al. |
| 7,865,324 | B2 | 1/2011 | Lindberg |
| 7,894,957 | B2 | 2/2011 | Carlson |
| 7,946,758 | B2 | 5/2011 | Mooring |
| 8,063,892 | B2 | 11/2011 | Shahoian et al. |
| 8,138,488 | B2 | 3/2012 | Grot |
| 8,143,981 | B2 | 3/2012 | Washizu et al. |
| 8,167,126 | B2 | 5/2012 | Stiehl |
| 8,169,402 | B2 | 5/2012 | Shahoian et al. |
| 8,188,989 | B2 | 5/2012 | Levin et al. |
| 8,195,313 | B1 | 6/2012 | Fadell et al. |
| 8,229,535 | B2 | 7/2012 | Mensinger et al. |
| 8,248,815 | B2 | 8/2012 | Yang et al. |
| 8,263,886 | B2 | 9/2012 | Lin et al. |
| 8,263,889 | B2 | 9/2012 | Takahashi et al. |
| 8,275,327 | B2 | 9/2012 | Yi et al. |
| 8,294,670 | B2 | 10/2012 | Griffin et al. |
| 8,312,495 | B2 | 11/2012 | Vanderhoff |
| 8,318,340 | B2 | 11/2012 | Stimits |
| 8,368,677 | B2 | 2/2013 | Yamamoto |
| 8,371,745 | B2 | 2/2013 | Manni |
| 8,373,661 | B2 | 2/2013 | Lan et al. |
| 8,405,618 | B2 | 3/2013 | Colgate |
| 8,410,971 | B2 | 4/2013 | Friedlander |
| 8,432,368 | B2 | 4/2013 | Momeyer et al. |
| 8,439,559 | B2 | 5/2013 | Luk et al. |
| 8,441,450 | B2 | 5/2013 | Degner et al. |
| 8,446,713 | B2 | 5/2013 | Lai |
| 8,456,430 | B2 | 6/2013 | Oliver et al. |
| 8,477,118 | B2 | 7/2013 | Lan et al. |
| 8,493,190 | B2 | 7/2013 | Periquet et al. |
| 8,508,511 | B2 | 8/2013 | Tanaka et al. |
| 8,525,777 | B2 | 9/2013 | Stavely et al. |
| 8,562,489 | B2 | 10/2013 | Burton et al. |
| 8,568,313 | B2 | 10/2013 | Sadhu |
| 8,576,044 | B2 | 11/2013 | Chapman |
| 8,593,598 | B2 | 11/2013 | Chen et al. |
| 8,607,662 | B2 | 12/2013 | Huang |
| 8,614,881 | B2 | 12/2013 | Yoo |
| 8,666,682 | B2 | 3/2014 | LaVigne et al. |
| 8,677,285 | B2 | 3/2014 | Tsern et al. |
| 8,704,787 | B2 | 4/2014 | Yamamoto |
| 8,711,093 | B2 | 4/2014 | Ong et al. |
| 8,717,151 | B2 | 5/2014 | Forutanpour et al. |
| 8,724,087 | B2 | 5/2014 | Van De Kerkhof et al. |
| 8,730,167 | B2 | 5/2014 | Ming et al. |
| 8,743,088 | B2 | 6/2014 | Watanabe |
| 8,783,944 | B2 | 7/2014 | Doi |
| 8,797,153 | B2 | 8/2014 | Vanhelle et al. |
| 8,804,993 | B2 | 8/2014 | Shukla et al. |
| 8,816,962 | B2 | 8/2014 | Obermeyer et al. |
| 8,824,245 | B2 | 9/2014 | Lau et al. |
| 8,847,741 | B2 | 9/2014 | Birnbaum et al. |
| 8,851,372 | B2 | 10/2014 | Zhou |
| 8,859,971 | B2 | 10/2014 | Weber |
| 8,860,674 | B2 | 10/2014 | Lee et al. |
| 8,863,219 | B2 | 10/2014 | Brown et al. |
| D717,679 | S | 11/2014 | Anderssen |
| 8,878,657 | B2 | 11/2014 | Periquet et al. |
| 8,885,856 | B2 | 11/2014 | Sacha |
| 8,895,911 | B2 | 11/2014 | Takahashi |
| 8,905,631 | B2 | 12/2014 | Sakurazawa et al. |
| 8,908,477 | B2 | 12/2014 | Peters |
| 8,920,022 | B2 | 12/2014 | Ishida et al. |
| 8,922,399 | B2 | 12/2014 | Bajaj et al. |
| 8,928,452 | B2 | 1/2015 | Kim et al. |
| 8,948,832 | B2 | 2/2015 | Hong et al. |
| 8,954,135 | B2 | 2/2015 | Yuen et al. |
| 8,975,543 | B2 | 3/2015 | Hakemeyer |
| 8,994,827 | B2 | 3/2015 | Mistry et al. |
| 9,001,625 | B2 | 4/2015 | Essery et al. |
| 9,024,733 | B2 | 5/2015 | Wouters |
| 9,028,134 | B2 | 5/2015 | Koshoji et al. |
| 9,030,446 | B2 | 5/2015 | Mistry et al. |
| 9,034,666 | B2 | 5/2015 | Vaganov et al. |
| 9,039,614 | B2 | 5/2015 | Yuen et al. |
| 9,041,663 | B2 | 5/2015 | Westerman |
| 9,042,971 | B2 | 5/2015 | Brumback et al. |
| 9,049,998 | B2 | 6/2015 | Brumback et al. |
| 9,052,696 | B2 | 6/2015 | Breuillot et al. |
| 9,086,717 | B2 | 7/2015 | Meerovitsch |
| 9,086,738 | B2 | 7/2015 | Leung et al. |
| 9,091,309 | B2 | 7/2015 | Battlogg |
| 9,100,493 | B1 | 8/2015 | Zhou |
| 9,101,184 | B2 | 8/2015 | Wilson |
| 9,105,413 | B2 | 8/2015 | Hiranuma et al. |
| 9,123,483 | B2 | 9/2015 | Ferri et al. |
| 9,134,807 | B2 | 9/2015 | Shaw et al. |
| 9,141,087 | B2 | 9/2015 | Brown et al. |
| 9,176,577 | B2 | 11/2015 | Jangaard et al. |
| 9,176,598 | B2 | 11/2015 | Sweetser et al. |
| 9,202,372 | B2 | 12/2015 | Reams et al. |
| 9,213,409 | B2 | 12/2015 | Redelsheimer et al. |
| 9,223,296 | B2 | 12/2015 | Yang et al. |
| 9,241,635 | B2 | 1/2016 | Yuen et al. |
| 9,244,438 | B2 | 1/2016 | Hoover et al. |
| 9,256,209 | B2 | 2/2016 | Yang et al. |
| 9,277,156 | B2 | 3/2016 | Bennett et al. |
| 9,350,850 | B2 | 5/2016 | Pope et al. |
| 9,367,146 | B2 | 6/2016 | Piot |
| 9,386,932 | B2 | 7/2016 | Chatterjee et al. |
| 9,426,275 | B2 | 8/2016 | Eim et al. |
| 9,430,042 | B2 | 8/2016 | Levin |
| 9,437,357 | B2 | 9/2016 | Furuki et al. |
| 9,449,770 | B2 | 9/2016 | Sanford et al. |
| 9,501,044 | B2 | 11/2016 | Jackson et al. |
| 9,520,100 | B2 | 12/2016 | Houjou et al. |
| 9,532,723 | B2 | 1/2017 | Kim |
| 9,542,016 | B2 | 1/2017 | Armstrong-Muntner |

(56) References Cited

U.S. PATENT DOCUMENTS 9,545,541 B2 1/2017 Aragones et al.
9,552,023 B2 1/2017 Joo et al.
9,599,964 B2 3/2017 Gracia
9,600,071 B2 3/2017 Rothkopf
9,607,505 B2 3/2017 Rothkopf et al.
9,620,312 B2 4/2017 Ely et al.
9,627,163 B2 4/2017 Ely
9,632,318 B2 4/2017 Goto et al.
9,632,537 B2 4/2017 Memering
9,638,587 B2 5/2017 Marquas et al.
9,651,922 B2 5/2017 Hysek et al.
9,659,482 B2 5/2017 Yang et al.
9,680,831 B2 6/2017 Jooste et al.
9,709,956 B1 7/2017 Ely et al.
9,753,436 B2 9/2017 Ely et al.
D800,172 S 10/2017 Akana
9,800,717 B2 10/2017 Ma et al.
9,836,025 B2 12/2017 Ely et al.
9,873,711 B2 1/2018 Hoover et al.
9,874,945 B2 1/2018 Fukumoto
9,886,006 B2 2/2018 Ely et al.
9,891,590 B2 2/2018 Shim et al.
9,891,651 B2 2/2018 Jackson et al.
9,898,032 B2 2/2018 Hafez et al.
9,927,902 B2 3/2018 Burr et al.
9,939,923 B2 4/2018 Sharma
9,946,297 B2 4/2018 Nazzaro et al.
9,952,558 B2 4/2018 Ely
9,952,682 B2 4/2018 Zhang et al.
9,971,305 B2 5/2018 Ely et al.
9,971,405 B2 5/2018 Holenarsipur et al.
9,971,407 B2 5/2018 Holenarsipur et al.
9,979,426 B2 5/2018 Na et al.
10,001,817 B2 6/2018 Zambetti et al.
10,012,550 B2 7/2018 Yang
10,018,966 B2 7/2018 Ely et al.
10,019,097 B2 7/2018 Ely et al.
10,037,006 B2 7/2018 Ely
10,037,081 B2 7/2018 Grant
10,048,802 B2 8/2018 Shedletsky
10,061,399 B2 8/2018 Bushnell et al.
10,066,970 B2 9/2018 Gowreesunker et al.
10,092,203 B2 10/2018 Mirov
10,108,016 B2 10/2018 Bosveld
10,114,342 B2 10/2018 Kim et al.
10,145,711 B2 12/2018 Boonsom et al.
10,175,652 B2 1/2019 Ely et al.
10,190,891 B1 1/2019 Rothkopf et al.
10,203,662 B1 2/2019 Lin et al.
10,209,148 B2 2/2019 Lyon et al.
10,216,147 B2 2/2019 Ely et al.
10,222,755 B2 * 3/2019 Coakley ..... G04B 37/10
10,222,756 B2 3/2019 Ely et al.
10,222,909 B2 3/2019 Shedletsky et al.
10,234,828 B2 3/2019 Ely et al.
10,241,593 B2 3/2019 Chen
10,296,125 B2 5/2019 Ely et al.
10,331,081 B2 6/2019 Ely et al.
10,331,082 B2 6/2019 Ely et al.
10,353,487 B2 7/2019 Chung et al.
10,379,629 B2 8/2019 Bushnell et al.
10,386,940 B2 8/2019 Kim
10,401,961 B2 9/2019 Cruz-Hernandez et al.
10,429,959 B2 10/2019 Battlogg
10,474,194 B1 11/2019 Ell et al.
10,503,258 B2 12/2019 Holenarsipur et al.
10,509,486 B2 12/2019 Bushnell et al.
10,524,671 B2 1/2020 Lamego
10,534,320 B2 1/2020 Ferri
10,551,798 B1 2/2020 Bushnell et al.
10,572,053 B2 2/2020 Ely et al.
10,599,101 B2 3/2020 Rothkopf et al.
10,610,157 B2 * 4/2020 Pandya ..... A61B 5/339
10,613,685 B2 4/2020 Shedletsky
10,627,783 B2 4/2020 Rothkopf et al.
10,655,988 B2 5/2020 Boonsom et al.
10,664,074 B2 5/2020 Moussette et al.
10,732,571 B2 8/2020 Ely et al.
10,765,019 B2 9/2020 Werner
10,845,764 B2 11/2020 Ely et al.
10,852,700 B2 12/2020 Abramov
10,852,855 B2 12/2020 Niu
10,871,385 B2 12/2020 Kok
10,936,071 B2 3/2021 Pandya et al.
10,962,930 B2 3/2021 Ely et al.
10,962,935 B1 3/2021 Ely et al.
10,987,054 B2 4/2021 Pandya et al.
11,002,572 B2 5/2021 Boonsom et al.
11,029,831 B2 6/2021 Block et al.
11,148,292 B2 10/2021 Bryner et al.
11,181,863 B2 * 11/2021 Ely ..... G04G 21/08
11,347,189 B1 5/2022 Herrera et al.
11,350,869 B2 6/2022 Rasmussen et al.
2002/0101457 A1 8/2002 Lang
2003/0174590 A1 9/2003 Arikawa et al.
2004/0047244 A1 3/2004 Iino et al.
2004/0082414 A1 4/2004 Knox
2004/0130971 A1 7/2004 Ecoffet et al.
2004/0264301 A1 12/2004 Howard et al.
2005/0075558 A1 4/2005 Vecerina et al.
2005/0088417 A1 4/2005 Mulligan
2006/0250377 A1 11/2006 Zadesky et al.
2007/0013775 A1 1/2007 Shin
2007/0050054 A1 3/2007 Sambandam Guruparan et al.
2007/0182708 A1 8/2007 Poupyrev et al.
2007/0211042 A1 9/2007 Kim et al.
2007/0222756 A1 9/2007 Wu et al.
2007/0229671 A1 10/2007 Takeshita et al.
2007/0247421 A1 10/2007 Orsley et al.
2008/0130914 A1 6/2008 Cho
2009/0051649 A1 2/2009 Rondel
2009/0073119 A1 3/2009 Le et al.
2009/0122656 A1 5/2009 Bonnet et al.
2009/0146975 A1 6/2009 Chang
2009/0152452 A1 6/2009 Lee et al.
2009/0217207 A1 8/2009 Kagermeier et al.
2009/0285443 A1 11/2009 Camp et al.
2009/0312051 A1 12/2009 Hansson et al.
2010/0033430 A1 2/2010 Kakutani et al.
2010/0053468 A1 3/2010 Havrill
2010/0081375 A1 4/2010 Rosenblatt et al.
2010/0149099 A1 6/2010 Elias
2011/0007468 A1 1/2011 Burton et al.
2011/0090148 A1 4/2011 Li et al.
2011/0158057 A1 6/2011 Brewer et al.
2011/0242064 A1 10/2011 Ono et al.
2011/0270358 A1 11/2011 Davis et al.
2012/0067711 A1 3/2012 Yang
2012/0068857 A1 3/2012 Rothkopf et al.
2012/0075082 A1 3/2012 Rothkopf et al.
2012/0112859 A1 5/2012 Park et al.
2012/0113044 A1 5/2012 Strazisar et al.
2012/0206248 A1 8/2012 Biggs
2012/0272784 A1 11/2012 Bailey et al.
2013/0037396 A1 2/2013 Yu
2013/0087443 A1 4/2013 Kikuchi
2013/0191220 A1 7/2013 Dent et al.
2013/0235704 A1 9/2013 Grinberg
2013/0261405 A1 10/2013 Lee et al.
2013/0335196 A1 12/2013 Zhang et al.
2014/0009397 A1 1/2014 Gillespie
2014/0045547 A1 2/2014 Singamsetty et al.
2014/0071098 A1 3/2014 You
2014/0073486 A1 3/2014 Ahmed et al.
2014/0132516 A1 5/2014 Tsai et al.
2014/0197936 A1 7/2014 Biggs et al.
2014/0340318 A1 11/2014 Stringer et al.
2014/0347289 A1 11/2014 Suh et al.
2014/0368442 A1 12/2014 Vahtola
2014/0375579 A1 12/2014 Fujiwara
2015/0049059 A1 2/2015 Zadesky et al.
2015/0098309 A1 4/2015 Adams et al.
2015/0124415 A1 5/2015 Goyal et al.
2015/0186609 A1 7/2015 Utter

(56) References Cited

U.S. PATENT DOCUMENTS

| | | | |
|---|---|---|---|
| 2015/0221460 | A1 | 8/2015 | Teplitxky et al. |
| 2015/0293592 | A1 | 10/2015 | Cheong |
| 2015/0320346 | A1 | 11/2015 | Chen |
| 2015/0338642 | A1 | 11/2015 | Sanford |
| 2015/0366098 | A1 | 12/2015 | Lapetina et al. |
| 2016/0018846 | A1 | 1/2016 | Zenoff |
| 2016/0054813 | A1 | 2/2016 | Shediwy et al. |
| 2016/0058375 | A1 | 3/2016 | Rothkopf et al. |
| 2016/0061636 | A1 | 3/2016 | Gowreesunker et al. |
| 2016/0062623 | A1 | 3/2016 | Howard et al. |
| 2016/0069713 | A1 | 3/2016 | Ruh et al. |
| 2016/0109861 | A1 | 4/2016 | Kim et al. |
| 2016/0116306 | A1 | 4/2016 | Ferri et al. |
| 2016/0147432 | A1 | 5/2016 | Shi et al. |
| 2016/0170598 | A1 | 6/2016 | Zambetti et al. |
| 2016/0170608 | A1 | 6/2016 | Zambetti et al. |
| 2016/0170624 | A1 | 6/2016 | Zambetti et al. |
| 2016/0241688 | A1 | 8/2016 | Vossoughi |
| 2016/0253487 | A1 | 9/2016 | Sarkar et al. |
| 2016/0306446 | A1 | 10/2016 | Chung et al. |
| 2016/0320583 | A1 | 11/2016 | Hall, Jr. |
| 2016/0327911 | A1 | 11/2016 | Eim et al. |
| 2016/0338642 | A1 | 11/2016 | Parara et al. |
| 2016/0378069 | A1 | 12/2016 | Rothkopf et al. |
| 2016/0378070 | A1 | 12/2016 | Rothkopf et al. |
| 2017/0011210 | A1 | 1/2017 | Cheong et al. |
| 2017/0027461 | A1 | 2/2017 | Shin et al. |
| 2017/0031449 | A1 | 2/2017 | Karsten et al. |
| 2017/0061863 | A1 | 3/2017 | Eguchi |
| 2017/0069443 | A1 | 3/2017 | Wang et al. |
| 2017/0069444 | A1 | 3/2017 | Wang et al. |
| 2017/0069447 | A1 | 3/2017 | Wang et al. |
| 2017/0090572 | A1 | 3/2017 | Holenarsipur |
| 2017/0090599 | A1 | 3/2017 | Kuboyama |
| 2017/0104902 | A1 | 4/2017 | Kim et al. |
| 2017/0139489 | A1 | 5/2017 | Chen et al. |
| 2017/0216519 | A1 | 8/2017 | Vouillamoz |
| 2017/0216668 | A1 | 8/2017 | Burton et al. |
| 2017/0238138 | A1 | 8/2017 | Aminzade |
| 2017/0251561 | A1 | 8/2017 | Fleck et al. |
| 2017/0269715 | A1 | 9/2017 | Kim et al. |
| 2017/0285404 | A1 | 10/2017 | Kubota et al. |
| 2017/0301314 | A1 | 10/2017 | Kim et al. |
| 2017/0307414 | A1 | 10/2017 | Ferri et al. |
| 2017/0331869 | A1 | 11/2017 | Bendahan et al. |
| 2017/0357465 | A1 | 12/2017 | Dzeryn et al. |
| 2018/0018026 | A1 | 1/2018 | Bushnell et al. |
| 2018/0136686 | A1 | 5/2018 | Jackson et al. |
| 2018/0196517 | A1 | 7/2018 | Tan et al. |
| 2018/0225701 | A1 | 8/2018 | Han |
| 2018/0235491 | A1 | 8/2018 | Bayley et al. |
| 2018/0337551 | A1 | 11/2018 | Park |
| 2019/0072911 | A1 | 3/2019 | Ely et al. |
| 2019/0072912 | A1 | 3/2019 | Pandya et al. |
| 2019/0278232 | A1 | 9/2019 | Ely et al. |
| 2019/0317454 | A1 | 10/2019 | Holenarsipur et al. |
| 2019/0391539 | A1 | 12/2019 | Perkins et al. |
| 2020/0041962 | A1 | 2/2020 | Beyhs |
| 2020/0064774 | A1 | 2/2020 | Ely et al. |
| 2020/0064779 | A1 | 2/2020 | Pandya et al. |
| 2020/0073339 | A1 | 3/2020 | Roach et al. |
| 2020/0110473 | A1 | 4/2020 | Bushnell et al. |
| 2020/0159172 | A1 | 5/2020 | Bushnell et al. |
| 2020/0233380 | A1 | 7/2020 | Rothkopf |
| 2020/0233529 | A1 | 7/2020 | Shedletsky et al. |
| 2021/0055696 | A1 | 2/2021 | Ely |
| 2021/0096688 | A1 | 4/2021 | Shedletsky et al. |
| 2021/0181682 | A1 | 6/2021 | Ely et al. |
| 2021/0181688 | A1 | 6/2021 | Ely et al. |
| 2021/0181690 | A1 | 6/2021 | Rothkopf et al. |
| 2021/0181691 | A1 | 6/2021 | Rothkopf et al. |
| 2021/0181692 | A1 | 6/2021 | Rothkopf et al. |
| 2021/0181865 | A1 | 6/2021 | Bushnell et al. |
| 2022/0043402 | A1 | 2/2022 | Roach et al. |
| 2022/0075328 | A1 | 3/2022 | Taylor |

FOREIGN PATENT DOCUMENTS

| | | |
|---|---|---|
| CN | 1445627 | 10/2003 |
| CN | 1504843 | 6/2004 |
| CN | 1601408 | 3/2005 |
| CN | 1624427 | 6/2005 |
| CN | 1792295 | 6/2006 |
| CN | 1825224 | 8/2006 |
| CN | 101035148 | 9/2007 |
| CN | 101201587 | 6/2008 |
| CN | 201081979 | 7/2008 |
| CN | 101404928 | 4/2009 |
| CN | 201262741 | 6/2009 |
| CN | 101750958 | 6/2010 |
| CN | 201638168 | 11/2010 |
| CN | 101923314 | 12/2010 |
| CN | 102067070 | 5/2011 |
| CN | 102216959 | 10/2011 |
| CN | 202008579 | 10/2011 |
| CN | 102590925 | 7/2012 |
| CN | 102890443 | 1/2013 |
| CN | 202710937 | 1/2013 |
| CN | 103177891 | 6/2013 |
| CN | 103191557 | 7/2013 |
| CN | 103253067 | 8/2013 |
| CN | 103645804 | 3/2014 |
| CN | 203564224 | 4/2014 |
| CN | 103852090 | 6/2014 |
| CN | 203630524 | 6/2014 |
| CN | 103956006 | 7/2014 |
| CN | 203693601 | 7/2014 |
| CN | 203705837 | 7/2014 |
| CN | 203732900 | 7/2014 |
| CN | 103995456 | 8/2014 |
| CN | 104020660 | 9/2014 |
| CN | 203941395 | 11/2014 |
| CN | 104777987 | 4/2015 |
| CN | 104685794 | 6/2015 |
| CN | 204479929 | 7/2015 |
| CN | 204496177 | 7/2015 |
| CN | 104880937 | 9/2015 |
| CN | 104898406 | 9/2015 |
| CN | 204650147 | 9/2015 |
| CN | 105022947 | 11/2015 |
| CN | 105096979 | 11/2015 |
| CN | 105339871 | 2/2016 |
| CN | 105547146 | 5/2016 |
| CN | 105556433 | 5/2016 |
| CN | 105683876 | 6/2016 |
| CN | 105760067 | 7/2016 |
| CN | 105955519 | 9/2016 |
| CN | 205645648 | 10/2016 |
| CN | 205721636 | 11/2016 |
| CN | 205750744 | 11/2016 |
| CN | 106236051 | 12/2016 |
| CN | 106557218 | 4/2017 |
| CN | 206147524 | 5/2017 |
| CN | 206209589 | 5/2017 |
| CN | 107111342 | 8/2017 |
| CN | 107122088 | 9/2017 |
| CN | 107966895 | 4/2018 |
| CN | 209560397 | 10/2019 |
| DE | 3706194 | 9/1988 |
| DE | 102008023651 | 11/2009 |
| DE | 102016215087 | 3/2017 |
| EP | 0165548 | 12/1985 |
| EP | 0556155 | 8/1993 |
| EP | 1345095 | 9/2003 |
| EP | 1519452 | 3/2005 |
| EP | 1669724 | 6/2006 |
| EP | 1832969 | 9/2007 |
| EP | 2375295 | 10/2011 |
| EP | 2579186 | 4/2013 |
| EP | 2720129 | 4/2014 |
| EP | 2884239 | 6/2015 |
| FR | 2030093 | 10/1970 |
| FR | 2801402 | 5/2001 |
| GB | 2433211 | 6/2007 |
| JP | S52151058 | 12/1977 |

(56) References Cited

FOREIGN PATENT DOCUMENTS

| | | |
|---|---|---|
| JP | S52164551 | 12/1977 |
| JP | S53093067 | 8/1978 |
| JP | S54087779 | 6/1979 |
| JP | S5708582 | 1/1982 |
| JP | S5734457 | 2/1982 |
| JP | S60103936 | 6/1985 |
| JP | S60103937 | 6/1985 |
| JP | H02285214 | 11/1990 |
| JP | H04093719 | 3/1992 |
| JP | H04157319 | 5/1992 |
| JP | H05203465 | 8/1993 |
| JP | H05312595 | 11/1993 |
| JP | H06050927 | 12/1994 |
| JP | H06331761 | 12/1994 |
| JP | H06347293 | 12/1994 |
| JP | H07116141 | 5/1995 |
| JP | H0914941 | 1/1997 |
| JP | H10161811 | 6/1998 |
| JP | H11121210 | 4/1999 |
| JP | H11191508 | 7/1999 |
| JP | 2000258559 | 9/2000 |
| JP | 2000316824 | 11/2000 |
| JP | 2000337892 | 12/2000 |
| JP | 2001084934 | 3/2001 |
| JP | 2001167651 | 6/2001 |
| JP | 2001202178 | 7/2001 |
| JP | 2001215288 | 8/2001 |
| JP | 2001524206 | 11/2001 |
| JP | 2002071480 | 3/2002 |
| JP | 2002165768 | 6/2002 |
| JP | 2003050668 | 2/2003 |
| JP | 2003151410 | 5/2003 |
| JP | 2003331693 | 11/2003 |
| JP | 2004184396 | 7/2004 |
| JP | 2004028979 | 11/2004 |
| JP | 2005017011 | 1/2005 |
| JP | 2005063200 | 3/2005 |
| JP | 2005099023 | 4/2005 |
| JP | 2005108630 | 4/2005 |
| JP | 2006101505 | 4/2006 |
| JP | 2006164275 | 6/2006 |
| JP | 3852854 | 12/2006 |
| JP | 2007101380 | 4/2007 |
| JP | 2007149620 | 6/2007 |
| JP | 2007248176 | 9/2007 |
| JP | 2007311153 | 11/2007 |
| JP | 2008053980 | 3/2008 |
| JP | 2008122124 | 5/2008 |
| JP | 2008122377 | 5/2008 |
| JP | 2008170436 | 7/2008 |
| JP | 2008235226 | 10/2008 |
| JP | 2009009382 | 1/2009 |
| JP | 2009070657 | 4/2009 |
| JP | 2009519737 | 5/2009 |
| JP | 2009540399 | 11/2009 |
| JP | 2010032545 | 2/2010 |
| JP | 2010515153 | 5/2010 |
| JP | 2010165001 | 7/2010 |
| JP | 2010186572 | 8/2010 |
| JP | 2010243344 | 10/2010 |
| JP | 2010244797 | 10/2010 |
| JP | 2011021929 | 2/2011 |
| JP | 2011165468 | 8/2011 |
| JP | 2011221659 | 11/2011 |
| JP | 2012053801 | 3/2012 |
| JP | 2013057516 | 3/2013 |
| JP | 2013079961 | 5/2013 |
| JP | 2013524189 | 6/2013 |
| JP | 3190075 | 4/2014 |
| JP | 5477393 | 4/2014 |
| JP | 2014512556 | 5/2014 |
| JP | 2014112222 | 6/2014 |
| JP | 2014174031 | 9/2014 |
| JP | 2018510451 | 4/2018 |
| KR | 20010030477 | 4/2001 |
| KR | 200278568 | 3/2002 |
| KR | 20070011685 | 1/2007 |
| KR | 20070014247 | 2/2007 |
| KR | 100754674 | 9/2007 |
| KR | 20080028935 | 4/2008 |
| KR | 20080045397 | 5/2008 |
| KR | 2020100007563 | 7/2010 |
| KR | 20110011393 | 2/2011 |
| KR | 20110012784 | 2/2011 |
| KR | 20110103761 | 9/2011 |
| KR | 20110113368 | 10/2011 |
| KR | 20130036038 | 4/2013 |
| KR | 20130131873 | 12/2013 |
| KR | 20140051391 | 4/2014 |
| KR | 20140064689 | 5/2014 |
| KR | 20140104388 | 8/2014 |
| KR | 20160017070 | 2/2016 |
| KR | 20160048967 | 5/2016 |
| KR | 20170106395 | 9/2017 |
| NL | 1040225 | 11/2014 |
| RO | 129033 | 11/2013 |
| TW | 200633681 | 10/2006 |
| WO | WO2001/022038 | 3/2001 |
| WO | WO2001/069567 | 9/2001 |
| WO | WO2003/032538 | 4/2003 |
| WO | WO2010/058376 | 5/2010 |
| WO | WO2012/083380 | 6/2012 |
| WO | WO2012/094805 | 7/2012 |
| WO | WO2014/018118 | 1/2014 |
| WO | WO2014/200766 | 12/2014 |
| WO | WO2015/147756 | 10/2015 |
| WO | WO2016080669 | 5/2016 |
| WO | WO2016/104922 | 6/2016 |
| WO | WO2016155761 | 10/2016 |
| WO | WO2016196171 | 12/2016 |
| WO | WO2016208835 | 12/2016 |
| WO | WO2017013278 | 1/2017 |
| WO | WO2020173085 | 9/2020 |

OTHER PUBLICATIONS

Author Unknown, "Fossil Q ups smartwatch game with handsome design and build," Business Mirror, Makati City, Philippines, 3 pages, Dec. 20, 2016.

Author Unknown, "How Vesag Helps Kids Women and Visitors," http://www.sooperarticles.com/health-fitness-articles/children-health-articles/how-vesag-helps-kids-women-visitors-218542.html, 2 pages, at least as early as May 20, 2015.

Author Unknown, "mHealth," http://mhealth.vesag.com/?m=201012, 7 pages, Dec. 23, 2010.

Author Unknown, "mHealth Summit 2010," http://www.virtualpressoffice.com/eventsSubmenu.do?page=exhibitorPage&showId=1551&companyId-5394, 5 pages, Nov. 18, 2010.

Author Unknown, "MyKronoz ZeTime: World's Most Funded Hybrid Smartwatch Raised over $3M on Kickstarter, Running until Apr. 27th," Business Wire, New York, New York, 3 pages, Apr. 21, 2017.

Author Unknown, "RedEye mini Plug-in Universal Remote Adapter for iPhone, iPod touch and iPad," Amazon.com, 4 pages, date unknown.

Author Unknown, "Re iPhone Universal Remote Control—Infrared Remote Control Accessory for iPhone and iPod touch," http://www.amazon.com/iPhone-Universal-Remote-Control-Accessory/dp/tech-data/B0038Z4 . . . , 2 pages, at least as early as Jul. 15, 2010.

Author Unknown, "Vesag Wrist Watch for Dementia Care from VYZIN," http://vyasa-kaaranam-ketkadey.blogspot.com/2011/03/vesag-wrist-watch-for-dementia-care.html, 2 pages, Mar. 31, 2011.

Author Unknown, "Vyzin Electronics Private Limited launches Vesag Watch," http://www.virtualpressoffice.com/showJointPage.do?page=jp&showId=1544, 5 pages, Jan. 6, 2011.

Author Unknown, "Vyzin Unveiled Personal Emergency Response System (PERS) with Remote Health Monitoring That Can Be Used for Entire Family," http://www.24-7pressrelease.com/press-release/vyzin-unveiled-personal-emergency-response-system-pers-with-remote-health-monitoring-that-can-be-used-for-entire-family-219317.php, 2 pages, Jun. 17, 2011.

(56) References Cited

OTHER PUBLICATIONS

Author Unknown, "DeskThorityNet, Optical Switch Keyboards," http://deskthority.net/keyboards-f2/optical-switch-keyboards-t1474.html, 22 pages, Jul. 11, 2015.
Epstein et al., "Economical, High-Performance Optical Encoders," Hewlett-Packard Journal, pp. 99-106, Oct. 1988. [text only version].
Greyb, "Google Watch: Convert your arm into a keyboard," http://www.whatafuture.com/2014/02/28/google-smartwatch/#sthash.Yk35cDXK.dpbs, 3 pages, Feb. 28, 2014.
IBM, "Additional Functionality Added to Cell Phone via "Learning" Function Button," www.ip.com, 2 pages, Feb. 21, 2007.
Kim, Joseph, "2010 mHealth Summit Emerges as Major One-Stop U.S. Venue for Mobile Health," http://www.medicineandtechnology.com/2010/08/2010-mhealth-summit-emerges-as-major.html, 3 pages, Aug. 26, 2010.
Krishnan et al., "A Miniature Surface Mount Reflective Optical Shaft Encoder," Hewlett-Packard Journal, Article 8, pp. 1-6, Dec. 1996.
Rick, "How VESAG Helps Health Conscious Citizens," http://sensetekgroup.com/2010/11/29/wireless-health-monitoring-system/, 2 pages, Nov. 29, 2010.
Sadhu, Rajendra, "How VESAG Helps People Who Want to 'Be There'?," http://ezinearticles.com/?How-Vesag-Helps-People-Who-Want-to-Be-There?&id-5423873, 1 page, Nov. 22, 2010.
Sadhu, Rajendra, "Mobile Innovation Helps Dementia and Alzheimer's Patients," http://www.itnewsafrica.com/2010/11/mobile-innovation-helps-dementia-andalzheimer%E2%80%99s-patients/, 3 pages, Nov. 22, 2010.
Sherr, Sol, "Input Devices," p. 55, Mar. 1988.
Tran et al., "Universal Programmable Remote Control/Telephone," www.ip.com, 2 pages, May 1, 1992.
Narayanaswami et al., "Challenges and considerations for the design and production of a purpose-optimized body-worn wristwatch computer," Defense, Security, and Cockpit Displays, 2004.
M.T. Raghunath et al., User Interfaces for Applications on a Wrist Watch, Personal and Ubiquitous Computing, vol. 6, No. 1, 2002, Springer.

* cited by examiner

CONDUCTIVE CAP FOR WATCH CROWN

CROSS-REFERENCE TO RELATED APPLICATIONS

This application is a continuation patent application of U.S. non-provisional patent application Ser. No. 16/221,549, filed Dec. 16, 2018 and titled "Conductive Cap for Watch Crown," which claims the benefit of U.S. Provisional Patent Application No. 62/722,796, filed Aug. 24, 2018 and titled "Conductive Cap for Watch Crown," the disclosures of which are hereby incorporated herein by reference in their entirety.

FIELD

The described embodiments relate generally to an electronic watch or other electronic device (e.g., another type of wearable electronic device). More particularly, the described embodiments relate to techniques for providing, on or as part of a watch or other wearable electronic device, a crown assembly that includes a shaft and a separate conductive cap.

BACKGROUND

A crown assembly for a watch may be rotated or translated to provide inputs to the electronic device. The crown assembly may be electrically conductive to determine a set of biological parameters of a user that wears the watch or other electronic device. Providing a unitary component that forms an exterior surface and a shaft of a crown assembly results in complex processes for material selection, manufacturing, and finishing.

SUMMARY

Embodiments of the systems, devices, methods, and apparatuses described in the present disclosure are directed to an electronic watch or other electronic device (e.g., another type of wearable electronic device) having a crown assembly that includes a conductive cap that is mechanically and electrically coupled to a shaft.

In a first aspect, the present disclosure describes an electronic watch. The electronic watch includes a housing. The electronic watch further includes a crown assembly. The crown assembly includes a user-rotatable crown comprising a conductive cap, a crown body at least partially surrounding the conductive cap, and an isolating component positioned between the conductive cap and the crown body. The crown assembly further includes a shaft extending through an opening in the housing and mechanically and electrically coupled to the conductive cap. A processing unit of the electronic watch is coupled to the conductive cap by the shaft and is operable to determine a biological parameter of a user based on a voltage at the conductive cap.

In another aspect, the present disclosure describes an electronic watch. The electronic watch includes a housing defining an opening and a processing unit disposed within the housing. An electrode is disposed on a surface of the housing and is configured to detect a first voltage. The electronic watch further includes a user-rotatable crown that includes a crown body defining a cavity and a second electrode disposed in the cavity and configured to detect a second voltage. The electronic watch further includes a shaft mechanically coupled to the crown body, extending through the opening in the housing, and configured to electrically couple the second electrode and the processing unit. The electronic watch further includes an attachment mechanism mechanically and electrically coupling the second electrode and the shaft. The processing unit is configured to generate an electrocardiogram using the first and second voltages.

In still another aspect of the disclosure, another electronic watch is described. The electronic watch includes a housing defining an opening and a processing unit disposed in the housing. The electronic watch further includes a display at least partially surrounded by the housing and operably coupled to the processing unit and a crown assembly. The crown assembly includes a user-rotatable crown body, and a shaft mechanically coupled to the user-rotatable crown body and electrically coupled to the processing unit, and extending through the opening in the housing. The crown assembly further includes a conductive cap at least partially surrounded by the user-rotatable crown body and mechanically and electrically coupled to the shaft. The electronic watch further includes a sensor configured to detect rotation of the user-rotatable crown body. The processing unit is configured to generate an electrocardiogram of a user in response to detecting a voltage at the conductive cap.

In addition to the exemplary aspects and embodiments described above, further aspects and embodiments will become apparent by reference to the drawings and by study of the following description.

BRIEF DESCRIPTION OF THE DRAWINGS

The disclosure will be readily understood by the following detailed description in conjunction with the accompanying drawings, wherein like reference numerals designate like structural elements, and in which.

Figure 1A:
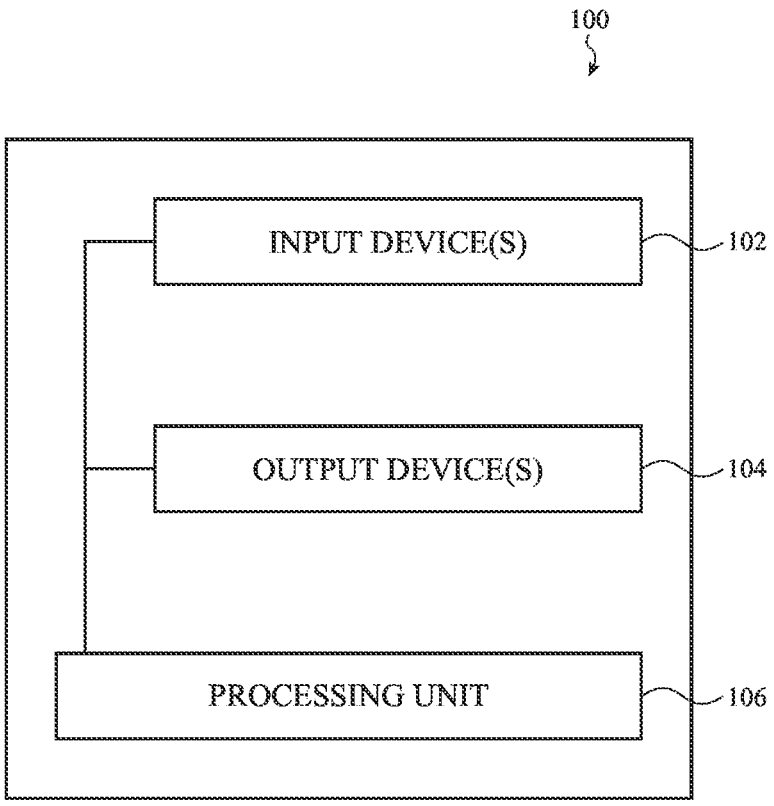
FIG. 1A shows a functional block diagram of an electronic device.

The use of cross-hatching or shading in the accompanying figures is generally provided to clarify the boundaries between adjacent elements and also to facilitate legibility of the figures. Accordingly, neither the presence nor the absence of cross-hatching or shading conveys or indicates any preference or requirement for particular materials, material properties, element proportions, element dimensions, commonalities of similarly illustrated elements, or any other characteristic, attribute, or property for any element illustrated in the accompanying figures.

Additionally, it should be understood that the proportions and dimensions (either relative or absolute) of the various features and elements (and collections and groupings thereof) and the boundaries, separations, and positional relationships presented therebetween, are provided in the accompanying figures merely to facilitate an understanding of the various embodiments described herein and, accordingly, may not necessarily be presented or illustrated to scale, and are not intended to indicate any preference or requirement for an illustrated embodiment to the exclusion of embodiments described with reference thereto.

DETAILED DESCRIPTION

Reference will now be made in detail to representative embodiments illustrated in the accompanying drawings. It should be understood that the following description is not intended to limit the embodiments to one preferred embodiment. To the contrary, it is intended to cover alternatives, modifications, and equivalents as can be included within the spirit and scope of the described embodiments as defined by the appended claims.

The following disclosure relates to embodiments and techniques for mechanically and electrically coupling a conductive cap of a crown assembly to a shaft of the crown assembly. In various embodiments, an electronic device such as an electronic watch, includes a crown assembly having a shaft and a user-rotatable crown that may be used to provide rotational and/or translational inputs to the electronic device.

The user-rotatable crown may include one or more conductive components (e.g., a conductive cap) that function as an electrode to sense voltages or signals indicative of one or more biological parameters of a user who is in contact with the conductive cap. The conductive components of the crown may be electrically and mechanically coupled to a conductive rotatable shaft that extends through an opening in a device housing. An end of the shaft interior to the housing, or a conductive shaft retainer interior to the housing, may be in mechanical and electrical contact with a connector (e.g., a spring-biased conductor) that carries electrical signals between the shaft or shaft retainer and a circuit (e.g., a processing unit), thereby providing electrical communication between the crown and the circuit.

In some devices, a conductive cap and the shaft may form a unitary component made of the same material. However, in many cases different material properties are useful and/or desired for the conductive cap than those of the shaft, making desirable a solution in which the conductive cap and the shaft are separate components. As described herein, in various embodiments, the conductive cap is a separate component from the shaft, and may be formed of a different material from the shaft (for example, in embodiments having different needs or features for each such component). As one non-limiting example, the conductive cap may define at least a portion of an exterior surface of the electronic device, so the material for the conductive cap may be selected for its cosmetic appearance in addition to its conductivity and ability to resist corrosion. The shaft may not be externally visible, so the material for the shaft may be selected without regard for its cosmetic appearance, and may instead be selected for other properties such as a combination of strength, conductivity, and ability to resist corrosion.

In various embodiments in which the conductive cap and the shaft are separate components, the conductive cap and the shaft must be mechanically and electrically coupled. As described herein, the conductive cap may be mechanically and/or electrically coupled to the shaft using a mechanical interlock, solder, another attachment mechanism, or some combination thereof. In some embodiments, the same attachment mechanism mechanically and electrically couples the conductive cap to the shaft. In some embodiments, separate attachment mechanisms mechanically and electrically couple the conductive cap to the shaft.

In some embodiments, the user-rotatable crown further includes a crown body that at least partially surrounds the conductive cap. The crown body may be electrically isolated from the conductive cap, for example by an isolating component positioned between the conductive cap and the crown body. In various embodiments, electrically isolating the crown body from the conductive cap may improve the function of the electronic device by reducing signal noise in signals received at the conductive cap, avoiding grounding of the conductive cap with the device housing, and the like. In some embodiments, one or more attachment mechanism(s) may attach the conductive cap to the crown body. In some cases, an attachment mechanism that mechanically and/or electrically couples the conductive cap to the shaft also mechanically couples the conductive cap to the crown body.

In some embodiments, one or more additional electrodes besides the conductive cap may be positioned on the exterior surface of the electronic device. Providing electrodes on different surfaces of a device may make it easier for a user to place different body parts in contact with different electrodes. In some embodiments, for example, the conductive cap is operable to be contacted by a finger of a user of the electronic device while another electrode is positioned against skin of the user. For example, a user may place one or more of the additional electrodes in contact with their wrist, and may touch the conductive cap (or another electrode) with a finger of their opposite hand (e.g., an electronic watch may be attached to a wrist adjacent one hand, and the crown may be touched with a finger of the opposite hand).

The conductive cap and/or the additional electrode(s) may sense voltages or signals indicative of one or more biological parameters of a user who is in contact with the conductive cap and/or the additional electrode(s). As discussed above, the shaft may electrically couple the conductive cap to a processing unit or other circuit of the electronic device. One or more electrically transmissive elements may couple the additional electrode(s) to the processing unit 106 or other circuit of the electronic device.

The processing unit of the electronic device, or a processing unit remote from the electronic device, may determine, from the voltages or signals at the electrodes (e.g., from stored digital samples or values representing the voltages or signals), the biological parameter(s) of the user. The biological parameter(s) may include, for example, an electrocardiogram (ECG) for the user, an indication of whether the user is experiencing atrial fibrillation, an indication of whether the user is experiencing premature atrial contraction or premature ventricular contraction, an indication of whether the user is experiencing a sinus arrhythmia, and so on.

These and other embodiments are discussed with reference to FIGS. 1-8. However, those skilled in the art will readily appreciate that the detailed description given herein with respect to these figures is for explanatory purposes only and should not be construed as limiting.

FIG. 1A shows a functional block diagram of an electronic device 100. In some examples, the device 100 may be an electronic watch or electronic health monitoring device. The electronic device 100 may include one or more input devices 102, one or more output devices 104, and a processing unit 106. Broadly, the input devices 102 may detect various types of input, and the output devices 104 may provide various types of output. The processing unit 106 may receive input signals from the input devices 102, in response to inputs detected by the input devices. The processing unit 106 may interpret input signals received from one or more of the input devices 102 and transmit output signals to one or more of the output devices 104. The output signals may cause the output devices 104 to provide one or more outputs. Detected input at one or more of the input devices 102 may be used to control one or more functions of the device 100. In some cases, one or more of the output devices 104 may be configured to provide outputs that are dependent on, or manipulated in response to, the input detected by one or more of the input devices 102. The outputs provided by one or more of the output devices 104 may also be responsive to, or initiated by, a program or application executed by the processing unit 106 and/or an associated companion device.

In various embodiments, the input devices 102 may include any suitable components for detecting inputs. Examples of input devices 102 include audio sensors (e.g., microphones), optical or visual sensors (e.g., cameras, visible light sensors, or invisible light sensors), proximity sensors, touch sensors, force sensors, mechanical devices (e.g., crowns, switches, buttons, or keys), vibration sensors, orientation sensors, motion sensors (e.g., accelerometers or velocity sensors), location sensors (e.g., global positioning system (GPS) devices), thermal sensors, communication devices (e.g., wired or wireless communication devices), resistive sensors, magnetic sensors, electroactive polymers (EAPs), strain gauges, electrodes, and so on, or some combination thereof. Each input device 102 may be configured to detect one or more particular types of input and provide a signal (e.g., an input signal) corresponding to the detected input. The signal may be provided, for example, to the processing unit 106.

The output devices 104 may include any suitable components for providing outputs. Examples of output devices 104 include audio output devices (e.g., speakers), visual output devices (e.g., lights or displays), tactile output devices (e.g., haptic output devices), communication devices (e.g., wired or wireless communication devices), and so on, or some combination thereof. Each output device 104 may be configured to receive one or more signals (e.g., an output signal provided by the processing unit 106) and provide an output corresponding to the signal.

The processing unit 106 may be operably coupled to the input devices 102 and the output devices 104. The processing unit 106 may be adapted to exchange signals with the input devices 102 and the output devices 104. For example, the processing unit 106 may receive an input signal from an input device 102 that corresponds to an input detected by the input device 102. The processing unit 106 may interpret the received input signal to determine whether to provide and/or change one or more outputs in response to the input signal. The processing unit 106 may then send an output signal to one or more of the output devices 104, to provide and/or change outputs as appropriate. Examples of suitable processing units are discussed in more detail below with respect to FIG. 10.

In some examples, the input devices 102 may include a set of one or more electrodes. The electrodes may be disposed on one or more exterior surfaces of the device 100. The processing unit 106 may monitor for voltages or signals received on at least one of the electrodes. In some embodiments, one of the electrodes may be permanently or switchably coupled to a device ground. The electrodes may be used to provide an ECG function for the device 100. For example, a 2-lead ECG function may be provided when a user of the device 100 contacts first and second electrodes that receive signals from the user. As another example, a 3-lead ECG function may be provided when a user of the device 100 contacts first and second electrodes that receive signals from the user, and a third electrode that grounds the user to the device 100. In both the 2-lead and 3-lead ECG embodiments, the user may press the first electrode against a first part of their body and press the second electrode against a second part of their body. The third electrode may be pressed against the first or second body part, depending on where it is located on the device 100.

Figure 1B:
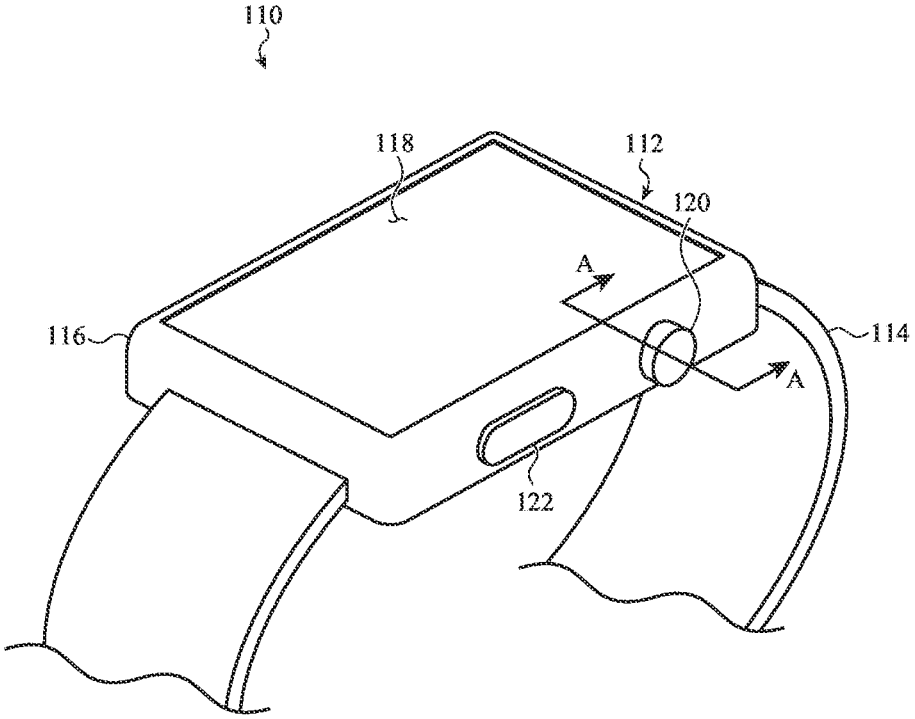
FIG. 1B shows an example of a watch that may incorporate a crown assembly.

FIG. 1B shows an example of a watch 110 (e.g., an electronic watch) that incorporates a crown assembly as described herein. The watch may include a watch body 112 and a watch band 114. Other devices that may incorporate a set of electrodes include other wearable electronic devices, other timekeeping devices, other health monitoring or fitness devices, other portable computing devices, mobile phones (including smart phones), tablet computing devices, digital media players, or the like.

The watch body 112 may include a housing 116. The housing 116 may include a front side housing member that faces away from a user's skin when the watch 110 is worn by a user, and a back side housing member that faces toward the user's skin. Alternatively, the housing 116 may include a singular housing member, or more than two housing members. The one or more housing members may be metallic, plastic, ceramic, glass, or other types of housing members (or combinations of such materials).

A cover sheet 118 may be mounted to a front side of the watch body 112 (i.e., facing away from a user's skin) and may protect a display mounted within the housing 116. The display may be viewable by a user through the cover sheet 118. In some cases, the cover sheet 118 may be part of a display stack, which display stack may include a touch sensing or force sensing capability. The display may be configured to depict a graphical output of the watch 110, and a user may interact with the graphical output (e.g., using a finger or stylus). As one example, the user may select (or otherwise interact with) a graphic, icon, or the like presented on the display by touching or pressing (e.g., providing touch input) on the display at the location of the graphic. As used herein, the term "cover sheet" may be used to refer to any transparent, semi-transparent, or translucent surface made out of glass, a crystalline material (such as sapphire or zirconia), plastic, or the like. Thus, it should be appreciated that the term "cover sheet," as used herein, encompasses amorphous solids as well as crystalline solids. The cover sheet 118 may form a part of the housing 116. In some examples, the cover sheet 118 may be a sapphire cover sheet. The cover sheet 118 may also be formed of glass, plastic, or other materials.

In some embodiments, the watch body 112 may include an additional cover sheet (not shown) that forms a part of the housing 116. The additional cover sheet may have one or more electrodes thereon.

The watch body 112 may include at least one input device or selection device, such as a crown assembly, scroll wheel, knob, dial, button, or the like, which input device may be operated by a user of the watch 110. In some embodiments, the watch 110 includes a crown assembly that includes a crown 120 and a shaft (not shown in FIG. 1B). For example, the housing 116 may define an opening through which the shaft extends. The crown 120 may be attached to the shaft, and may be accessible to a user exterior to the housing 116. The crown 120 may be user-rotatable, and may be manipulated (e.g., rotated) by a user to rotate or translate the shaft. The shaft may be mechanically, electrically, magnetically, and/or optically coupled to components within the housing 116 as one example. A user's manipulation of the crown 120 and shaft may be used, in turn, to manipulate or select various elements displayed on the display, to adjust a volume of a speaker, to turn the watch 110 on or off, and so on. The housing 116 may also include an opening through which a button 122 protrudes. In some embodiments, the crown 120, scroll wheel, knob, dial, button 122, or the like may be conductive, or have a conductive surface, and a signal route may be provided between the conductive portion of the crown 120, scroll wheel, knob, dial, button 122, or the like and a circuit within the watch body 112. In some embodiments, the crown 120 may be part of a crown assembly as described with reference to FIGS. 2-4.

The housing 116 may include structures for attaching the watch band 114 to the watch body 112. In some cases, the structures may include elongate recesses or openings through which ends of the watch band 114 may be inserted and attached to the watch body 112. In other cases (not shown), the structures may include indents (e.g., dimples or depressions) in the housing 116, which indents may receive ends of spring pins that are attached to or threaded through ends of a watch band to attach the watch band to the watch body. The watch band 114 may be used to secure the watch 110 to a user, another device, a retaining mechanism, and so on.

In some examples, the watch 110 may lack any or all of the cover sheet 118, the display, the crown 120, or the button 122. For example, the watch 110 may include an audio input or output interface, a touch input interface, a force input or haptic output interface, or other input or output interface that does not require the display, crown 120, or button 122. The watch 110 may also include the afore-mentioned input or output interfaces in addition to the display, crown 120, or button 122. When the watch 110 lacks the display, the front side of the watch 110 may be covered by the cover sheet 118, or by a metallic or other type of housing member.

Figure 2:
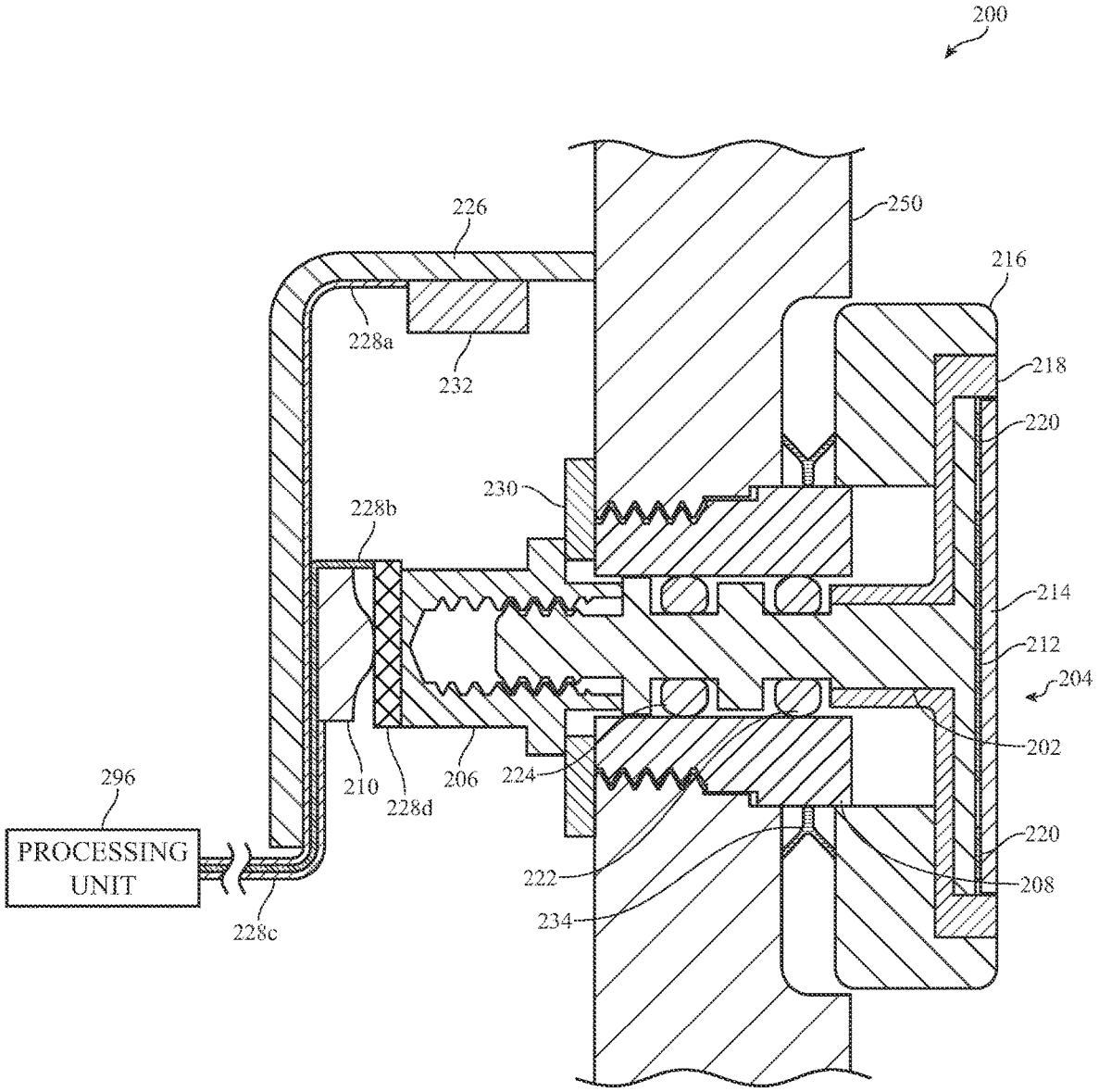
FIG. 2 shows a cross-section view of an example of a crown assembly, taken through section line A-A of FIG. 1B.

Turning now to FIG. 2, there is shown an example of a crown assembly 200, taken through section line A-A of FIG. 1B. FIG. 2 shows an assembled cross-section of a crown assembly 200, as viewed from the front or rear face of a watch body. The crown assembly 200 may include a conductive rotatable shaft 202 configured to extend through an opening in a housing 250, such as the housing described with reference to FIG. 1B. A user-rotatable crown 204 may be mechanically and/or electrically coupled to the shaft 202 exterior to the housing 250. The crown 204 may be rotated by a user of an electronic watch, to in turn rotate the shaft 202. As used herein, "mechanically coupled" includes direct attachment and indirect connection using one or more additional components, and "electrically coupled" includes direct conductive connection and indirect conductive connection using one or more additional components. In some cases, the crown 204 may also be pulled or pushed by the user to translate the shaft 202 along its axis (e.g., left and right with respect to FIG. 2). The crown 204 may be electrically coupled to a circuit within the housing 250 (e.g., a processing unit 296), but electrically isolated from the housing 250.

In some cases, the crown 204 includes a conductive cap 214 at least partially surrounded by a crown body 216. In some cases, the conductive cap 214 is electrically and mechanically coupled to the shaft 202. The conductive cap 214 may function as an electrode as discussed above with respect to FIGS. 1A-1B. The conductive cap 214 may be formed of any suitable conductive material or combination of materials, including titanium, steel, brass, ceramic, doped materials (e.g., plastics). In various embodiments, it is advantageous for the conductive cap 214 to resist corrosion, so material(s) may be selected that are resistant to corrosion, such as titanium. In some embodiments, one or more attachment mechanism(s) may mechanically couple the conductive cap to the crown body. In some cases, an attachment mechanism that mechanically and/or electrically couples the conductive cap to the shaft also mechanically couples the conductive cap to the crown body.

As discussed above, in some cases, the conductive cap 214 is electrically and mechanically coupled to the shaft 202. In various embodiments, one or more attachment components 212 mechanically and/or electrically couple the conductive cap 214 and the shaft 202. The attachment component 212 may include one or more fasteners, mechanical interlocks, adhesives, or some combination thereof. In some embodiments, multiple components mechanically and/or electrically couple the conductive cap 214 and the shaft 202. For example, the crown 204 may include a component 220 disposed between the conductive cap 214 and the shaft 202. The component 220 may at least partially surround the attachment component 212. The component 220 may include one or more fasteners, adhesives, or the like to mechanically couple the conductive cap 214 and the shaft 202 and/or a conductive material for electrically coupling the conductive cap 214 and the shaft 202.

In various embodiments, the component 220 may include additional or alternative functionality and structure. For example, the component 220 may serve as a standoff or spacer between the conductive cap 214 and the shaft 202. Additionally or alternatively, the component 220 may prevent the ingress of contaminants and other substances into the space between the conductive cap 214 and the shaft 202. For example, the component 220 may include one or more adhesives (e.g., liquid glue, heat-activated film, pressure-sensitive adhesive) or other substances (e.g., oil) for forming a barrier to exclude contaminants.

In various embodiments, an isolating component 218 may electrically isolate the conductive cap 214 from the crown body 216. The isolating component 218 may help prevent shorting of the crown 204 to the housing 250 and/or the crown body 216. The crown body 216 may be formed of any suitable material, including conductive and non-conductive materials (e.g., aluminum, stainless steel, or the like). In some embodiments, one or more components of the crown 204 may have a conductive surface covered by a thin non-conductive coating. The non-conductive coating may provide a dielectric for capacitive coupling between the conductive surface and a finger of a user of the crown 204 (or an electronic watch or other device that includes the crown assembly 200). In the same or different embodiments, the crown 204 may have a non-conductive coating on a surface of the crown 204 facing the housing 250. In some examples, the conductive material(s) may include a PVD deposited layer of aluminum titanium nitride (AlTiN) or chromium silicon carbonitride (CrSiCN).

In some embodiments, the crown body 216 is conductive and functions as an electrode. For example, the conductive cap 214 may be a first electrode and the crown body 216 may be a second electrode for use in an ECG (e.g., a 2-lead ECG). In some embodiments, the conductive cap 214 and the crown body 216 may be the only electrodes on the watch 110. In some embodiments, there may be one or more additional electrodes in addition to the conductive cap 214 and the crown body 216. For example, the crown body 216 (or the conductive cap 214) may function as an electrode (e.g., a third electrode in a 3-lead ECG) that grounds the user to the watch 110.

In various embodiments, the shaft 202 may be mechanically and/or electrically coupled to one or more additional components of the crown 204, including the conductive cap 214 and/or the crown body 216. The shaft 202 may be mechanically coupled to the crown 204 using a mechanical interlock, adhesives, fasteners, or some combination thereof. In some embodiments, the isolating component 218 mechanically couples the shaft 202 with the crown body 216. For example, as shown and described below with respect to FIG. 4, the isolating component 218 may form a mechanical interlock between the shaft 202 and the crown body 216. The isolating component 218 may be formed of any suitable electrically isolating or other non-conductive material, such as plastic. In some embodiments, the isolating component 218 may be insert molded between the shaft 202 and the crown body 216.

Figure 3A:
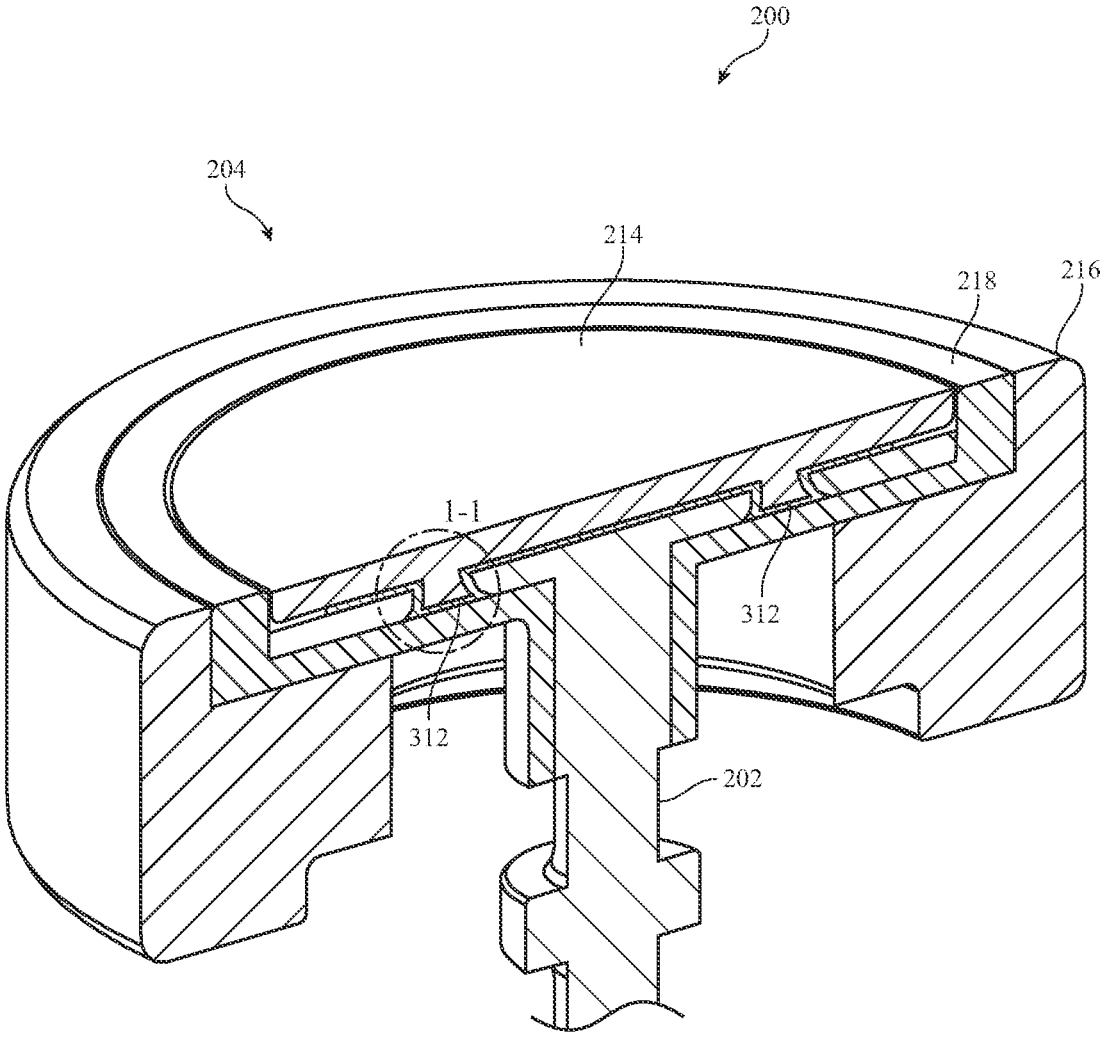
FIG. 3A shows a cross-section view of an example embodiment of a crown assembly.

FIG. 3A shows a cross-section view of an example embodiment of the crown assembly 200. As discussed above with respect to FIG. 2, the crown assembly 200 includes a crown 204 and a shaft 202. The conductive cap 214 of the crown 204 is mechanically and electrically coupled to the shaft 202 by attachment mechanism 312. As shown in FIG. 3A, the conductive cap 214 may form a first portion of an exterior surface of the crown 204, the crown body 216 may form a second portion of the exterior surface of the crown 204, and the isolating component may form a third portion of the exterior surface of the user-rotatable crown. In some embodiments, the attachment mechanism 312 is a solder joint (e.g., formed of solder), but may be any suitable conductive material, including conductive adhesives or the like.

The attachment mechanism 312 may be formed of any suitable conductive material, and may mechanically and electrically couple the conductive cap 214 and the shaft 202. The attachment mechanism 312 may electrically couple the conductive cap 214 and the shaft 202 by contacting both the conductive cap 214 and the shaft 202 to form a signal path between the two components. This allows the watch 110 to measure a biological parameter such as an ECG by coupling to a user's finger.

Figure 3B:
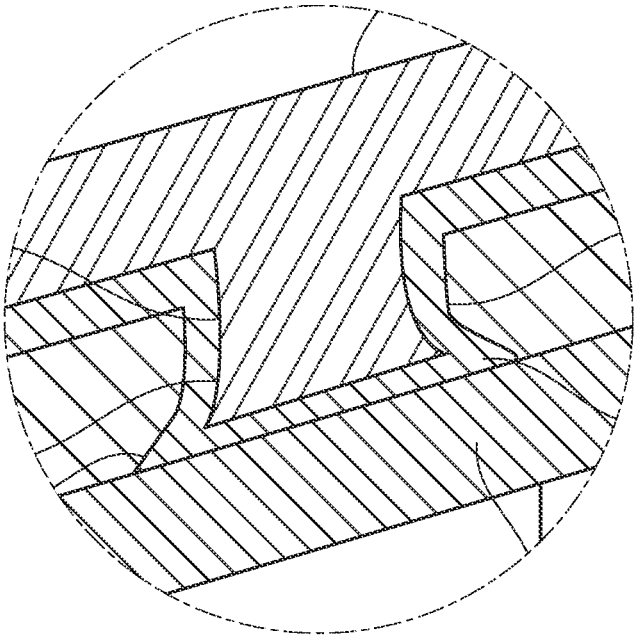
FIG. 3B shows a detailed view of area 1-1 shown in FIG. 3A.

In some embodiments, the attachment mechanism 312 mechanically couples the conductive cap 214 and the shaft 202 by forming (or functioning as) a mechanical bond between the two components. In some embodiments, the shaft 202 and/or the conductive cap 214 include one or more features (e.g., openings, orifices, protrusions, threads, teeth, or the like) to facilitate mechanical and/or electrical coupling. For example, the conductive cap 214 may include one or more protrusions and the shaft 202 may include one or more orifices. FIG. 3B shows a detailed view of area 1-1 shown in FIG. 3A. As shown in FIG. 3B, the shaft 202 includes an orifice 313 and the conductive cap 214 includes a protrusion 317 to facilitate mechanical and/or electrical coupling of the conductive cap 214 and the shaft 202. In some embodiments, the protrusion 317 may be positioned at least partially within the orifice 313, and the attachment mechanism 312 (e.g., the solder joint) may be positioned between the conductive cap 214 and the shaft 202 to mechanically and/or electrically couple the conductive cap 214 and the shaft 202. In some embodiments, the attachment mechanism 312 is not a separate material or component, and the conductive cap 214 and the shaft 202 are mechanically and/or electrically coupled directly, for example using a press fit or molding process. In some embodiments, the orifice 313 may be a through hole. In some embodiments, the orifice 313 may be a blind hole.

In some cases, the attachment mechanism includes a mechanical interlock. For example, the protrusion, the orifice, and/or the solder may cooperate to form a mechanical interlock (e.g., a mechanical coupling) between the conductive cap 214 and the shaft 202. In some embodiments, the orifice 313 includes an undercut region 315, another indentation, or another feature to facilitate a mechanical interlock between the conductive cap 214 and the shaft 202. Similarly, in some embodiments, the protrusion 317 may include an interlock feature 319 to facilitate a mechanical interlock between the conductive cap 214 and the shaft 202. Example interlock features include a flare, a skirt, and the like. For example, as shown in FIG. 3B, the undercut region 315 and the interlock feature 319 create a stronger mechanical coupling by creating a mechanical interlock between the conductive cap 214 and the shaft 202. In some embodiments, the interlock feature extends all the way around the protrusion. In some embodiments, the interlock feature include one or more features positioned at different locations around the protrusion. In some embodiments, the undercut region 315 and/or the interlock feature 319 may be shaped differently than the embodiment of FIG. 3B. For example, the interlock feature 319 may form a T-shape, and the undercut region 315 may form a corresponding T-shape configured to receive the interlock feature 319. In some embodiments, the shaft 202 may include one or more protrusions and the conductive cap 214 may include one or more orifices configured to receive the protrusion(s).

As discussed above, in one embodiment, the attachment mechanism 312 is a solder joint. The solder may be disposed on the protrusion 317 such that when the protrusion 317 is positioned within the orifice 313 and the solder is heated, the solder melts to occupy the space(s) between the conductive cap 214 and the shaft 202 to mechanically and/or electrically couple the two components. As shown in FIG. 3B, in some embodiments, the attachment mechanism 312 (e.g., the solder joint) is disposed at least partially within the orifice 313. In various embodiments the isolating component 218 may thermally insulate the crown body 216 as the solder is heated to avoid damage to the crown body 216, such as cracking. Additionally or alternatively, the shaft 202 may act as a heat sink to cool the solder to avoid damage to the crown body 216.

Figure 3C:
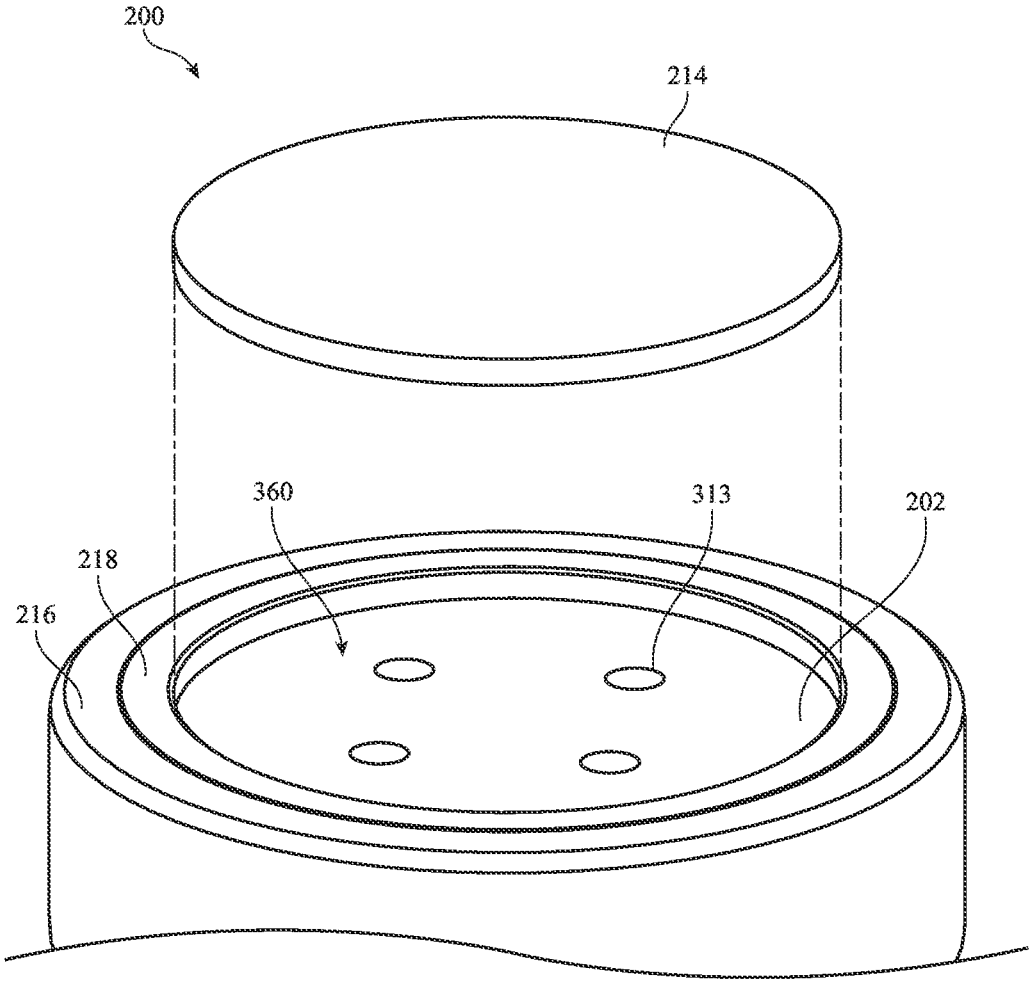
FIG. 3C shows a partial view of the example crown assembly of FIG. 3A with the conductive cap removed.
Figure 3D:
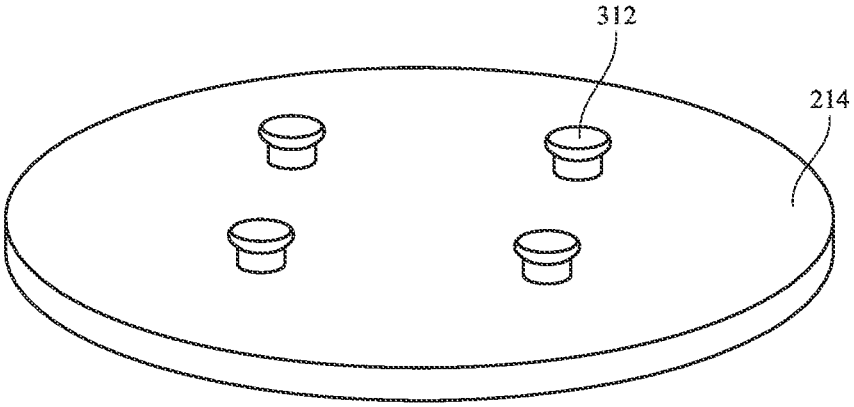
FIG. 3D shows a bottom view of the conductive cap of FIG. 3A.

In various embodiments, the conductive cap 214 may include multiple protrusions 317. Similarly, the shaft 202 may include multiple orifices 313. The protrusions 317 and the orifices 313 may be arranged such that each protrusion 317 may be positioned at least partially within an orifice 313. FIG. 3C shows a partial view of the example crown assembly 200 with the conductive cap 214 removed. As shown in FIG. 3C, the shaft 202 may include four orifices 313 arranged in a square or rectangular pattern. FIG. 3D shows a bottom view of the conductive cap 214. As shown in FIG. 3D, the conductive cap 214 may include four protrusions 317 arranged in a similar pattern as the orifices 313 shown in FIG. 3C. As described above, a solder joint or another attachment mechanism may be positioned on the protrusions 317, within the orifices 313, or some combination thereof to facilitate mechanical and/or electrical coupling of the conductive cap 214 and the shaft 202.

In the examples shown in FIGS. 3C and 3D, four orifices 313 and four protrusions 317 are shown for illustrative purposes. In various embodiments, any number of orifices or protrusions may be included.

As shown in FIG. 3C, the crown body 216 and/or the shaft 202 may define a cavity 360. The conductive cap 214, the isolating component 218, and/or one or more additional components of the crown assembly 200 may be disposed in the cavity and at least partially surrounded by the crown body 216. In some embodiments, the isolating component 218 is at least partially disposed in the cavity 360 around a periphery of the conductive cap 214. In some embodiments, the crown body 216 defines a through hole and the shaft extends at least partially through the through hole, and the shaft 202 may cooperate with the crown body 216 to define the cavity 360.

Figure 4:
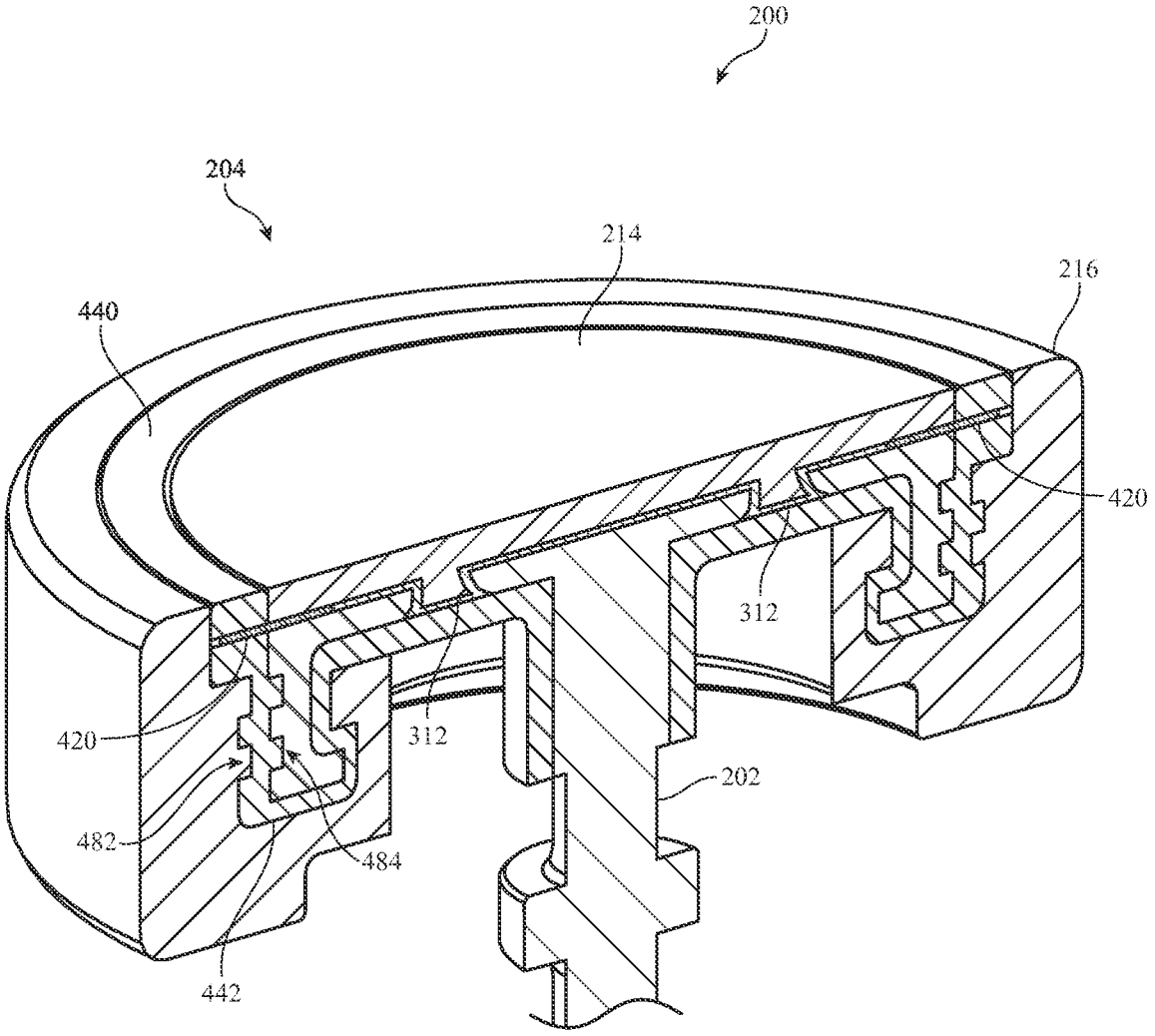
FIG. 4 shows a cross-section view of an example embodiment of a crown assembly.

As discussed above with respect to FIGS. 3A-3B, the isolating component 218 may electrically isolate the conductive cap 214 from the crown body 216 and it may thermally insulate the crown body 216 as the attachment mechanism 312 or another component of the crown assembly is heated. As shown in FIG. 3A, the isolating component 218 may also define a portion of an exterior surface of the crown assembly 200. In various embodiments, it may be advantageous to include a separate component that defines the portion of the exterior surface of the crown assembly 200. For example certain materials may offer better thermal and/or electrical isolation, but lack cosmetic features required for an exterior component. FIG. 4 shows an example cross-section view of an embodiment of the crown assembly 200 that includes an external isolating component 440 that defines a portion of the exterior surface of the crown assembly 200 and/or electrically isolates the conductive cap 214 and the crown body 216. FIG. 4 also shows an internal isolating component 442 positioned between the shaft 202 and the crown body 216.

The internal isolating component 442 may be substantially similar to the isolating component 218 as discussed above, and may include similar materials and installation techniques. The external isolating component 440 may include similar materials as discussed above with respect to the isolating component 218. It may be insert molded similar to the isolating component 218 or it may be placed within the crown body and otherwise attached to the crown assembly 200. For example, the crown assembly 200 may include a component 420, similar to the component 220 discussed above with respect to FIG. 2. The component 420 may include an adhesive or other fastener configured to mechanically couple the external isolating component 440 to the internal isolating component 442, the shaft 202, and/or another component of the crown assembly 200.

As shown in FIG. 3A, a gap between the conductive cap 214 and the shaft 202 may expose the attachment mechanism 312 to an exterior environment and/or contaminants from an exterior environment. For example, solder may be corroded or otherwise damaged by contaminants or other substances contacting it. Returning to FIG. 4, in various embodiments, in addition to or in the component 420 may form a seal to prevent the ingress of contaminants. For example, the component 420 may include a gasket disposed around a top surface of the shaft 202. Additionally or alternatively, the component 420 may serve a variety of functions, including acting as a spacer or standoff, electrically isolating components of the crown assembly 200, electrically coupling components of the crown assembly, or the like.

As discussed above, in some embodiments, the external isolating component 440 and the internal isolating component 442 are combined as a single component. In various embodiments, the external isolating component 440, the internal isolating component 442, and/or a combined isolating component may form a mechanical interlock between any or all of the isolating component, the shaft 202, and one or more components of the crown 204. For example, as shown in FIG. 4, the crown body 216 may cooperate with the internal isolating component 442 to form a mechanical interlock 482. The shaft 202 may cooperate with the internal isolating component 442 to form a mechanical interlock 484. The crown body 216, the internal isolating component 442, and the shaft 202 may cooperate to form a mechanical interlock (e.g., a combination of mechanical interlocks 482, 484). In some embodiments, the isolating component 218 may be insert molded between the shaft 202 and the crown body 216 In some embodiments, the shaft is directly mechanically coupled to the crown body 216, for example, using a mechanical interlock, adhesives, fasteners, or some combination thereof.

In various embodiments, some of the components shown and described with respect to FIGS. 2-4 may be omitted, arranged differently, or otherwise different. For example, in some embodiments, the shaft 202 and the crown body 216 are combined as a single component.

Returning now to FIG. 2, a shaft retainer 206 may be mechanically connected to the shaft 202, interior to the housing 250 (e.g., interior to a watch body housing), after the shaft is inserted through the opening in the housing 250 with the crown 204 positioned exterior to the housing 250. In some cases, the shaft retainer 206 may include a nut, and the shaft 202 may have a threaded male portion that engages a threaded female portion of the nut. In some cases, the shaft retainer 206 may be conductive, or have a conductive coating thereon, and mechanical connection of the shaft retainer 206 to the shaft 202 may form an electrical connection between the shaft retainer 206 and the shaft 202. In an alternative embodiment (not shown), the shaft retainer 206 may be integrally formed with the shaft 202, and the shaft 202 may be inserted through the opening in the housing 250 from inside the housing and then attached to the crown 204 (e.g., the crown 204 may screw onto the shaft 202).

A washer 230 may be positioned between the shaft retainer 206 and the housing 250 or another component of the electronic device. For example, a non-conductive (e.g., plastic) washer, plate, or shim may be mechanically coupled to the interior of the housing 250, between the shaft retainer 206 and the housing 250. The washer 230 may provide a bearing surface for the shaft retainer 206.

In some embodiments, a collar 208 may be aligned with the opening in the housing 250. In some embodiments, the collar 208 be coupled to the housing 250 or another component internal to the housing (not shown) via threads on a male portion of the collar 208 and corresponding threads on a female portion of the housing 250. Optionally, a gasket made of a synthetic rubber and fluoropolymer elastomer (e.g., Viton), silicone, or another compressible material may be disposed between the collar 208 and the housing 250 to provide stability to the collar 208 and/or provide a moisture barrier between the collar 208 and the housing 250. Another gasket 234 (e.g., a Y-ring) made of Viton, silicone, or another compressible material may be placed over the collar 208, before or after insertion of the collar 208 through the opening, but before the shaft 202 is inserted through the collar 208. The second gasket 234 may provide a moisture barrier between the crown 204 and the housing 150 and/or the crown 204 and the collar 208.

As shown in FIG. 2, one or more O-rings 222, 224 or other gaskets may be placed over the shaft 202 before the shaft 202 is inserted into the collar 208. The O-rings 222, 224 may be formed of a synthetic rubber and fluoropolymer elastomer, silicone, or another compressible material. In some cases, the O-rings 222, 224 may provide a seal between the shaft 202 and the collar 208. The O-rings 222, 224 may also function as an insulator between the shaft 202 and the collar 208. In some embodiments, the O-rings 222, 224 may be fitted to recesses in the shaft 202.

In some embodiments, a rotation sensor 232 for detecting rotation of the crown 204 and/or the shaft 202 is disposed within the housing 250. The rotation sensor 232 may include one or more light emitters and/or light detectors. The light emitter(s) may illuminate an encoder pattern or other rotating portion of the shaft 202 or shaft retainer 206. The encoder pattern may be carried on (e.g., formed on, printed on, etc.) the shaft 202 or the shaft retainer 206. The light detector(s) may receive reflections of the light emitted by the light emitter(s), and the processing unit 296 may determine a direction of rotation, speed of rotation, angular position, translation, or other state(s) of the crown 204 and shaft 202. In some embodiments, the rotation sensor 232 may detect rotation of the crown 204 by detecting rotation of the shaft 202. The rotation sensor 232 may be electrically coupled to the processing unit 296 of the electronic device by a connector 228*a*.

In some embodiments, a translation sensor 210 for detecting translation of the crown 204 and/or the shaft 202 is disposed within the housing 250. In some embodiments, the translation sensor 210 includes an electrical switch, such as a tactile dome switch, which may be actuated or change state in response to translation of the shaft 202. Thus, when a user presses on the crown 204, the shaft 202 may translate into the housing 250 (e.g., into the housing of a watch body) and actuate the switch, placing the switch in one of a number of states. When the user releases pressure on the crown 204 or pulls the crown 204 outward from the housing 250, the switch may retain the state in which it was placed when pressed, or advance to another state, or toggle between two states, depending on the type or configuration of the switch.

In some embodiments, the translation sensor 210 includes one or more light emitters and/or light detectors. The light emitter(s) may illuminate an encoder pattern or other portion of the shaft 202 or shaft retainer 206. The light detector(s) may receive reflections of the light emitted by the light emitter(s), and a processing unit 296 may determine a direction of rotation, speed of rotation, angular position, translation, or other state(s) of the crown 204 and shaft 202. In some embodiments, the rotation sensor 232 may detect translation of the crown 204 by detecting rotation of the shaft 202. The translation sensor 210 may be electrically coupled to a processing unit 296 of the electronic device by a connector 228*c*.

In various embodiments, the shaft 202 and the conductive cap 214 are in electrical communication with a processing unit 296 and/or one or more other circuits of an electronic device. One or more connectors may electrically couple the shaft 202 to the processing unit 296 and/or one or more other circuits. In some cases, the shaft retainer 206 is conductive and cooperates with one or more connectors to couple the shaft 202 to the processing unit 296 and/or one or more other circuits. In various cases, a connector 228*d* is in mechanical and electrical contact with the shaft retainer 206 (or in some cases with the shaft 202, such as when the shaft extends through the shaft retainer (not shown)). In some cases, the connector 228*d* may be formed (e.g., stamped or bent) from a piece of metal (e.g., stainless steel). In other cases, the connector 228*d* may take on any of several forms and materials. When the shaft 202 is translatable, translation of the shaft 202 into the housing 250 (e.g., into the housing of a watch body) may cause the connector 228*d* to deform or move. However, the connector 228*d* may have a spring bias or other mechanism which causes the connector 228*d* to maintain electrical contact with the shaft retainer or shaft end, regardless of whether the shaft 202 is in a first position or a second position with reference to translation of the shaft 202.

In some embodiments of the crown assembly 200 shown in FIG. 2, the connector 228*d* may include a conductive brush that is biased to contact a side of the shaft 202 or a side of the shaft retainer 206. The conductive brush may maintain electrical contact with the shaft 202 or shaft retainer 206 through rotation or translation of the shaft 202, and may be electrically connected to the processing unit 296 and/or another circuit such that the shaft remains electrically coupled to the processing unit as the shaft rotates. This allows the crown 204, and in particular the conductive cap 214 and/or the crown body 216, to remain electrically coupled to the processing unit 296 as the crown 204 is manipulated (e.g., rotated and/or translated) by a user, which allows the electrode(s) on the crown 204 to maintain their functionality as the crown 204 is manipulated.

The processing unit 296 or other circuit of the electronic device may be in electrical communication with the crown 204 (e.g., the conductive cap 214) via the connector 228*d*, the shaft retainer 206, and the shaft 202 (or when an end of the shaft 202 protrudes through the shaft retainer 206, the processing unit 296 or other circuit may be in electrical communication with the crown 204 via the connector 228*d* and the shaft 202). In some cases, the connector 228*d* is coupled to the processing unit 296 via an additional connector 228*b* (e.g., a cable, flex, or other conductive member). In some cases, as shown in FIG. 2, the connector 228*d* may be positioned between the shaft retainer 206 and the translation sensor 210. The connector 228*d* may be attached to the shaft retainer 206 and/or the translation sensor 210. In some cases, the connector 228*d* may be connected to the processing unit 296 via the translation sensor 210 and/or the connector 228*c*. In some cases, the connector 228*d* is integrated with the translation sensor 210. For example, the shaft retainer 206 may be electrically coupled to the translation sensor 210 to couple the crown 204 to the processing unit 296.

In some embodiments, a bracket 226 may be attached (e.g., laser welded) to the housing 250 or another element within the housing 250. The rotation sensor 232 and/or the translation sensor 210 may be mechanically coupled to bracket 226, and the bracket 226 may support the rotation sensor 232 and/or the translation sensor 210 within the housing 250. In the embodiment shown in FIG. 2, the rotation sensor 232 and the translation sensor 210 are shown as separate components, but in various embodiments, the rotation sensor 232 and the translation sensor 210 may be combined and/or located in different positions from those shown.

The bracket 226 may support a connector 228*b* (e.g., a spring-biased conductor)

The connectors 228*a-c* may be electrically coupled to the processing unit 296, for example as discussed with respect to FIG. 10 below. The processing unit 296 may determine whether a user is touching the conductive cap 214 of the crown 204, and/or determine a biological parameter of the user based on a signal received from or provided to the user via the conductive cap 214, or determine other parameters based on signals received from or provided to the conductive cap 214. In some cases, the processing unit 296 may operate the crown and electrodes described herein as an electrocardiogram and provide an ECG to a user of a watch including the crown and electrodes.

As discussed above, graphics displayed on the electronic devices herein may be manipulated through inputs provided to the crown. FIGS. 5A-7B generally depict examples of changing a graphical output displayed on an electronic device through inputs provided by force and/or rotational inputs to a crown assembly of the device. This manipulation (e.g., selection, acknowledgement, motion, dismissal, magnification, and so on) of a graphic may result in changes in operation of the electronic device and/or graphical output displayed by the electronic device. Although specific examples are provided and discussed, many operations may be performed by rotating and/or applying force to a crown such as the examples described above. Accordingly, the following discussion is by way of example and not limitation.

Figure 5A:
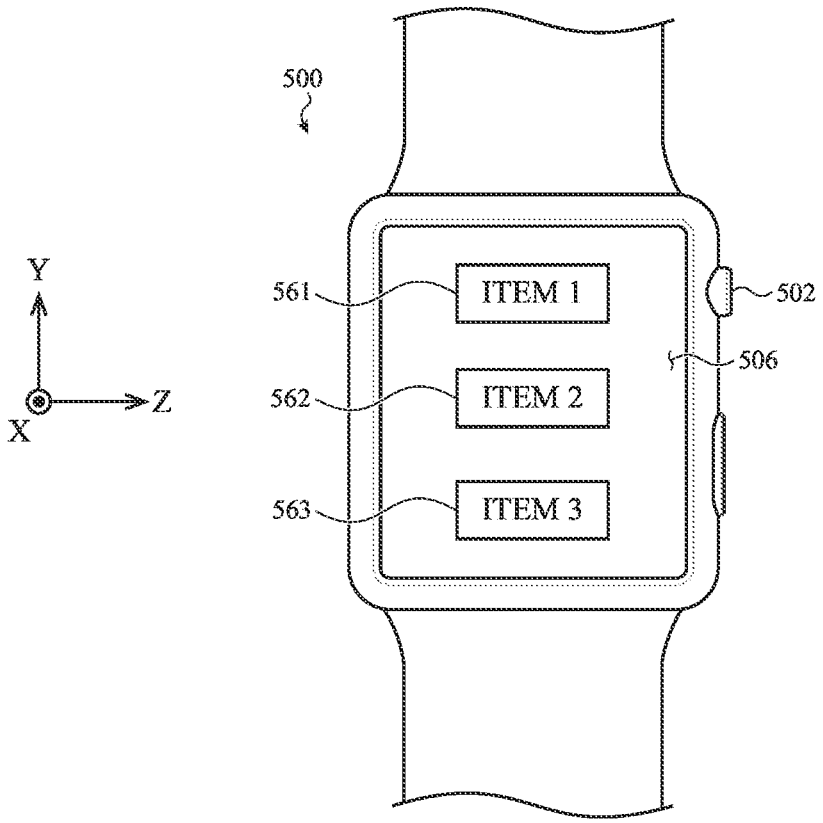
FIGS. 5A-7B generally depict examples of manipulating graphics displayed on an electronic device through inputs provided by force and/or rotational inputs to a crown of the device.

FIG. 5A depicts an example electronic device 500 (shown here as an electronic watch) having a crown 502. The crown 502 may be similar to the examples described above, and may receive force inputs along a first lateral direction, a second lateral direction, or an axial direction of the crown. The crown 502 may also receive rotational inputs. A display 506 provides a graphical output (e.g., shows information and/or other graphics). In some embodiments, the display 506 may be configured as a touch-sensitive display capable of receiving touch and/or force input. In the current example, the display 506 depicts a list of various items 561, 562, 563, all of which are example indicia.

Figure 5B:
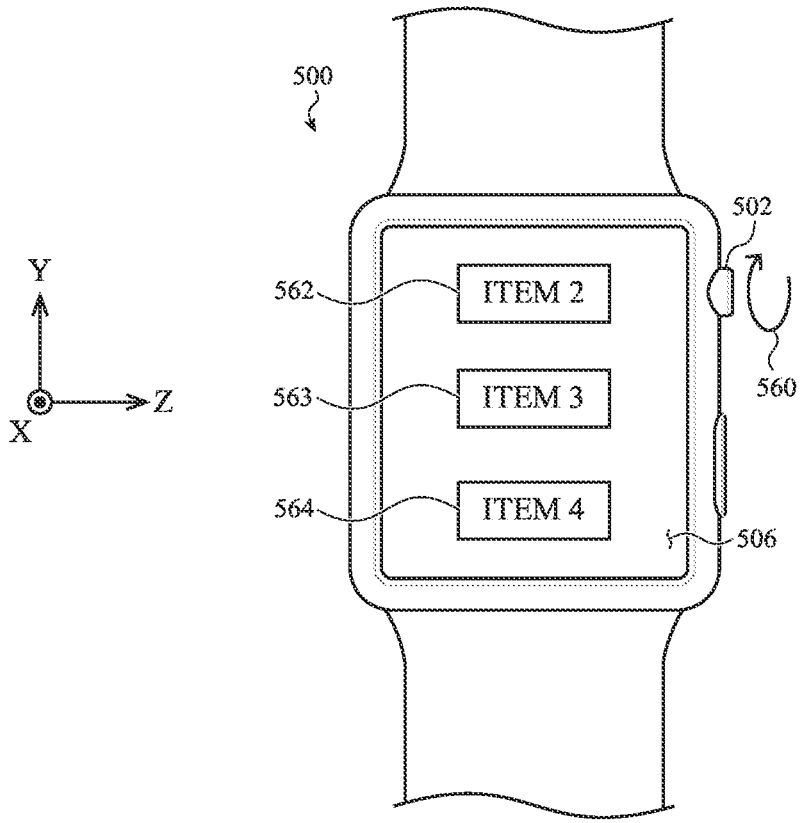

FIG. 5B illustrates how the graphical output shown on the display 506 changes as the crown 502 rotates, partially or completely (as indicated by the arrow 560). Rotating the crown 502 causes the list to scroll or otherwise move on the screen, such that the first item 561 is no longer displayed, the second and third items 562, 563 each move upwards on the display, and a fourth item 564 is now shown at the bottom of the display. This is one example of a scrolling operation that can be executed by rotating the crown 502. Such scrolling operations may provide a simple and efficient way to depict multiple items relatively quickly and in sequential order. A speed of the scrolling operation may be controlled by the amount of rotational force applied to the crown 502 and/or the speed at which the crown 502 is rotated. Faster or more forceful rotation may yield faster scrolling, while slower or less forceful rotation yields slower scrolling. The crown 502 may receive an axial force (e.g., a force inward toward the display 506 or watch body) to select an item from the list, in certain embodiments.

Figure 6A:
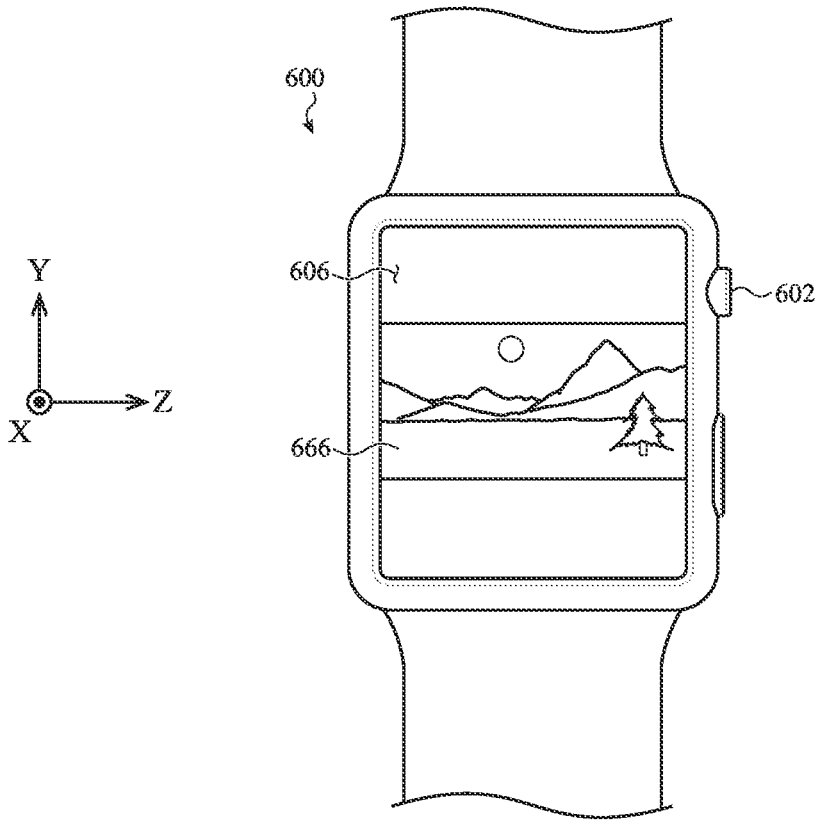
Figure 6B:
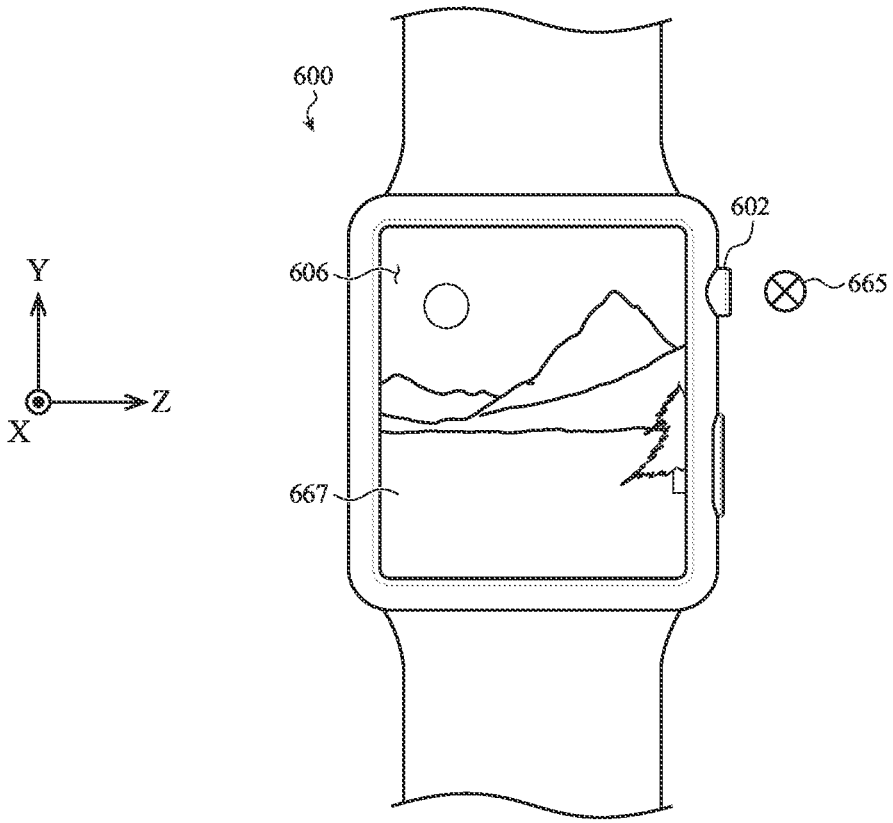

FIGS. 6A and 6B illustrate an example zoom operation. The display 606 depicts a picture 666 at a first magnification, shown in FIG. 6A; the picture 666 is yet another example of an indicium. A user may apply a lateral force (e.g., a force along the x-axis) to the crown 602 of the electronic device 600 (illustrated by arrow 665), and in response the display may zoom into the picture 666, such that a portion 667 of the picture is shown at an increased magnification. This is shown in FIG. 6B. The direction of zoom (in vs. out) and speed of zoom, or location of zoom, may be controlled through force applied to the crown 602, and particularly through the direction of applied force and/or magnitude of applied force. Applying force to the crown 602 in a first direction may zoom in, while applying force to the crown 602 in an opposite direction may zoom out. Alternately, rotating or applying force to the crown 602 in a first direction may change the portion of the picture subject to the zoom effect. In some embodiments, applying an axial force (e.g., a force along the z-axis) to the crown 602 may toggle between different zoom modes or inputs (e.g., direction of zoom vs. portion of picture subject to zoom). In yet other embodiments, applying force to the crown 602 along another direction, such as along the y-axis, may return the picture 666 to the default magnification shown in FIG. 6A.

Figure 7A:
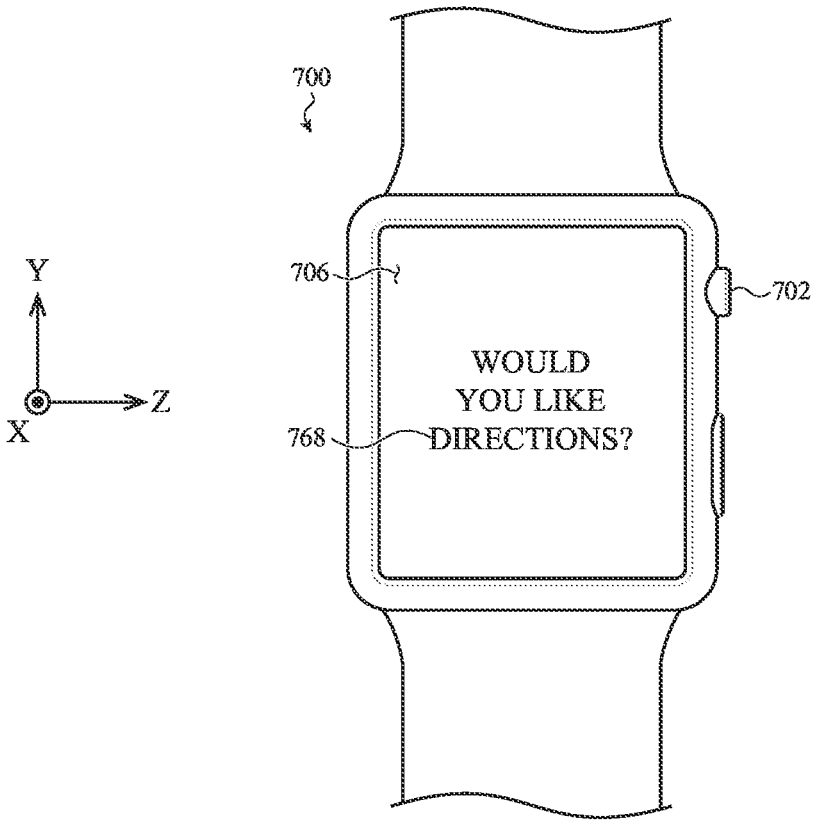
Figure 7B:
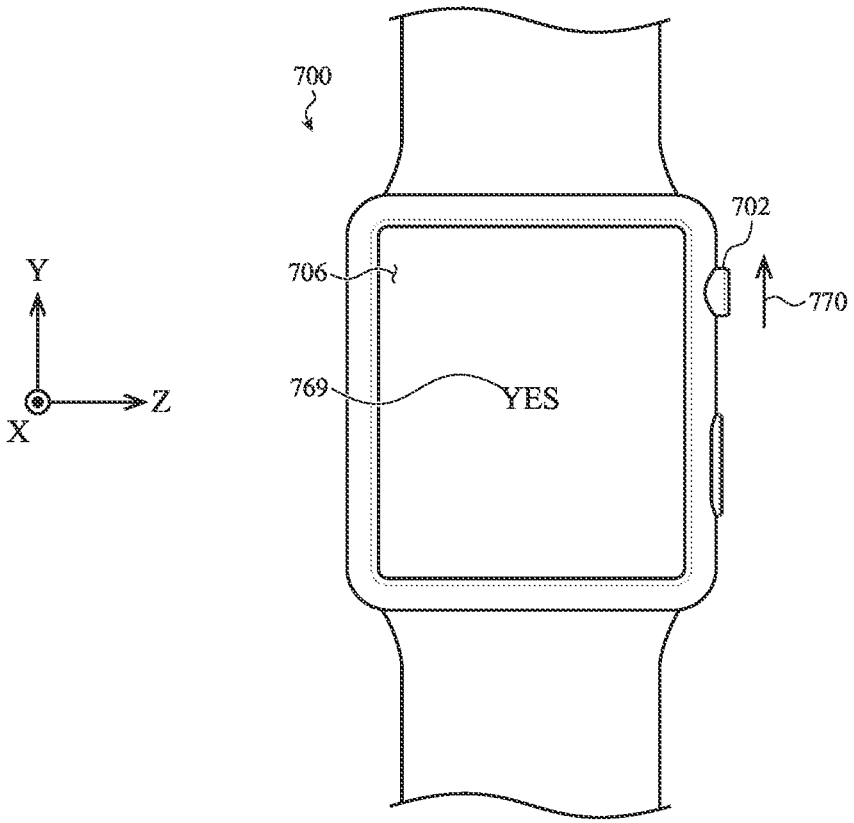

FIGS. 7A and 7B illustrate possible use of the crown 702 to change an operational state of the electronic device 700 or otherwise toggle between inputs. Turning first to FIG. 7A, the display 706 depicts a question 768, namely, "Would you like directions?" As shown in FIG. 7B, a lateral force may be applied to the crown 702 (illustrated by arrow 770) to answer the question. Applying force to the crown 702 provides an input interpreted by the electronic device 700 as "yes," and so "YES" is displayed as a graphic 769 on the display 706. Applying force to the crown 702 in an opposite direction may provide a "no" input. Both the question 768 and graphic 769 are examples of indicia.

In the embodiment shown in FIGS. 7A and 7B, the force applied to the crown 702 is used to directly provide the input, rather than select from options in a list (as discussed above with respect to FIGS. 5A and 5B).

As mentioned previously, force or rotational input to a crown of an electronic device may control many functions beyond those listed here. The crown may receive distinct force or rotational inputs to adjust a volume of an electronic device, a brightness of a display, or other operational parameters of the device. A force or rotational input applied to the crown may rotate to turn a display on or off, or turn the device on or off. A force or rotational input to the crown may launch or terminate an application on the electronic device. Further, combinations of inputs to the crown may likewise initiate or control any of the foregoing functions, as well.

In some cases, the graphical output of a display may be responsive to inputs applied to a touch-sensitive display (e.g., displays 506, 606, 706, and the like) in addition to inputs applied to a crown. The touch-sensitive display may include or be associated with one or more touch and/or force sensors that extend along an output region of a display and which may use any suitable sensing elements and/or sensing techniques to detect touch and/or force inputs applied to the touch-sensitive display. The same or similar graphical output manipulations that are produced in response to inputs applied to the crown may also be produced in response to inputs applied to the touch-sensitive display. For example, a swipe gesture applied to the touch-sensitive display may cause the graphical output to move in a direction corresponding to the swipe gesture. As another example, a tap gesture applied to the touch-sensitive display may cause an item to be selected or activated. In this way, a user may have multiple different ways to interact with and control an electronic watch, and in particular the graphical output of an electronic watch. Further, while the crown may provide overlapping functionality with the touch-sensitive display, using the crown allows for the graphical output of the display to be visible (without being blocked by the finger that is providing the touch input).

Figure 8:
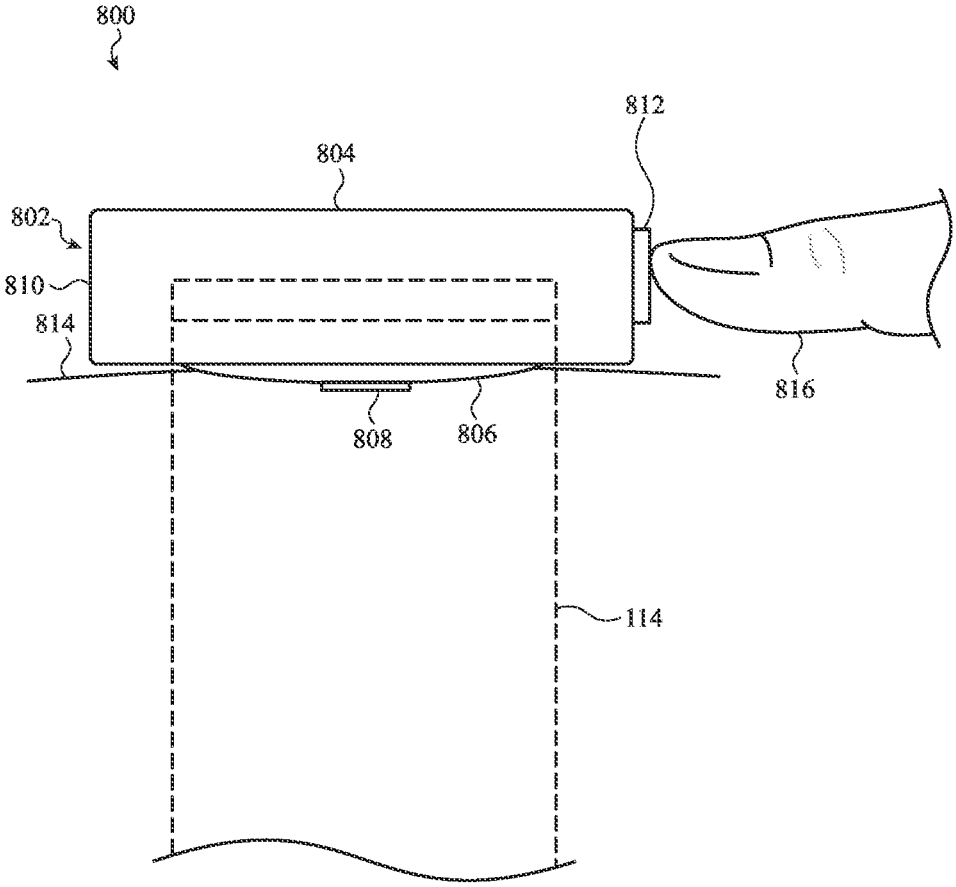
FIG. 8 shows an elevation of a watch body capable of sensing a biological parameter.

FIG. 8 shows an elevation of a watch body 800 capable of sensing a biological parameter. The watch body 800 may be an example of the watch body described with reference to FIG. 1B. The watch body 800 is defined by a housing 802, and the housing 802 may include a first cover sheet 804 that is part of or a display or display cover, a second cover sheet 806 having an exterior surface that supports one or more electrodes 808, one or more other housing members 810 defining sidewalls of the watch body 800, and a crown 812. The watch body 800 may be abutted to a user's wrist 814 or other body part, and may be adhered to the user by a watch band or other element (not shown). When abutted to a user's wrist 814, the electrode(s) 808 on the second cover sheet 806 may contact the user's skin. The user may touch the conductive cap (not shown) of the crown 812 with a finger 816. In some cases, the user may touch the crown 812 while also touching their wrist. However, high skin-to-skin impedance tends to reduce the likelihood that signals will travel from the electrodes 808, through their wrist 814 to their finger 816, and subsequently to the crown 812 (or vice versa). The intended signal path for acquiring an ECG is between one of the electrode(s) 808 on the second cover sheet 806 and the crown 812 via both of the user's arms and chest.

Figure 9:
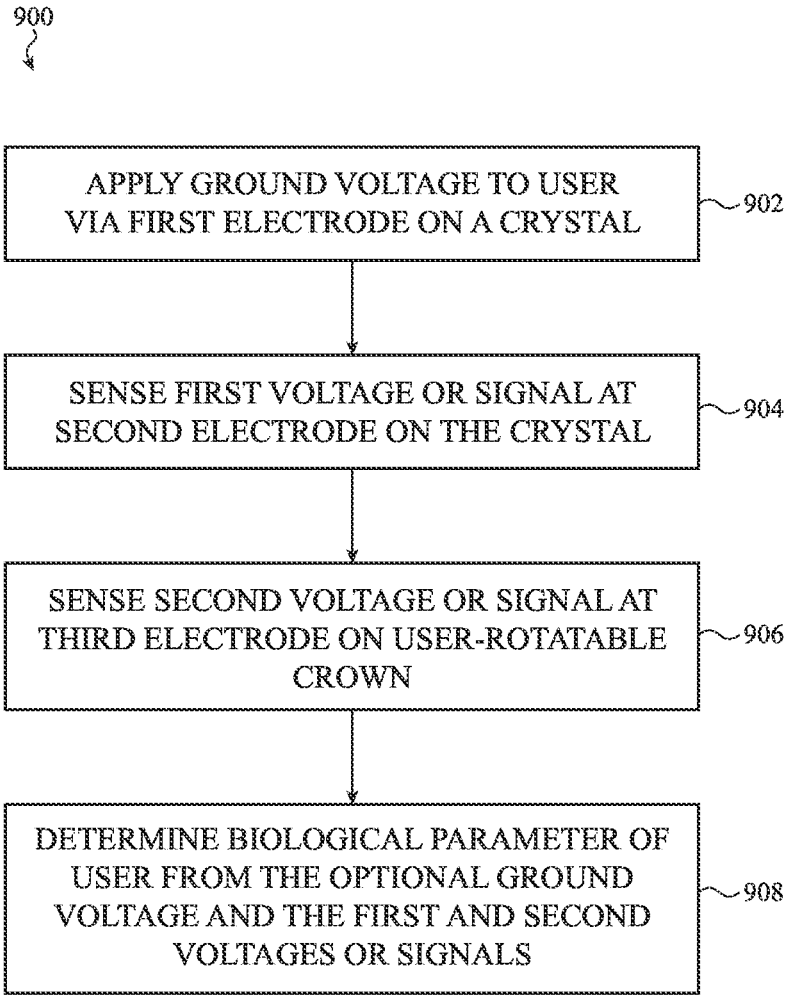
FIG. 9 shows an example method of determining a biological parameter of a user wearing a watch or other wearable electronic device.

FIG. 9 shows an example method 900 of determining a biological parameter of a user wearing an electronic watch or other wearable electronic device, such as a watch or wearable electronic device described herein.

At block 902, a ground voltage is optionally applied to a user via a first electrode on the electronic device. The first electrode may be on an exterior surface of a cover sheet that forms part of a housing of the electronic device. The operation(s) at 902 may be performed, for example, by the processing unit described with reference to FIG. 10, using one of the electrodes described with reference to FIGS. 1A-8.

At block 904, a first voltage or signal is sensed at a second electrode on the electronic device. The second electrode may also be on the exterior surface of the cover sheet. The operation(s) at 904 may be performed, for example, by the processing unit described with reference to FIG.10, using one of the electrodes described with reference to FIGS. 1A-8.

At block 906, a second voltage or signal is sensed at a third electrode on the electronic device. The third electrode may be on a user-rotatable crown of the electronic device (e.g., the conductive cap 214 discussed above), on a button of the electronic device, or on another surface of the housing of the electronic device. In some embodiments, the ground voltage is applied, and the first voltage or signal is sensed on a wrist of one arm of the user, and the second voltage or signal is sensed on a fingertip of the user (with the fingertip belonging to a finger on a hand on the other arm of the user). The operation(s) at 906 may be performed, for example, by the processing unit described with reference to FIG. 10, using one of the electrodes described with reference to FIGS. 1A-8.

At block 908, the biological parameter of the user may be determined from the optional ground voltage, the first voltage or signal, and the second voltage or signal. The ground voltage may provide a reference for the first and second voltages or signals, or may otherwise be used to reject noise from the first and second voltages or signals. When the first and second voltages are obtained from different parts of the user's body, the biological parameter may be an electrocardiogram for the user. For example, the voltages may be used to generate an electrocardiogram for the user. The operation(s) at 908 may be performed, for example, by the processing unit described with reference to FIG. 10.

Figure 10:
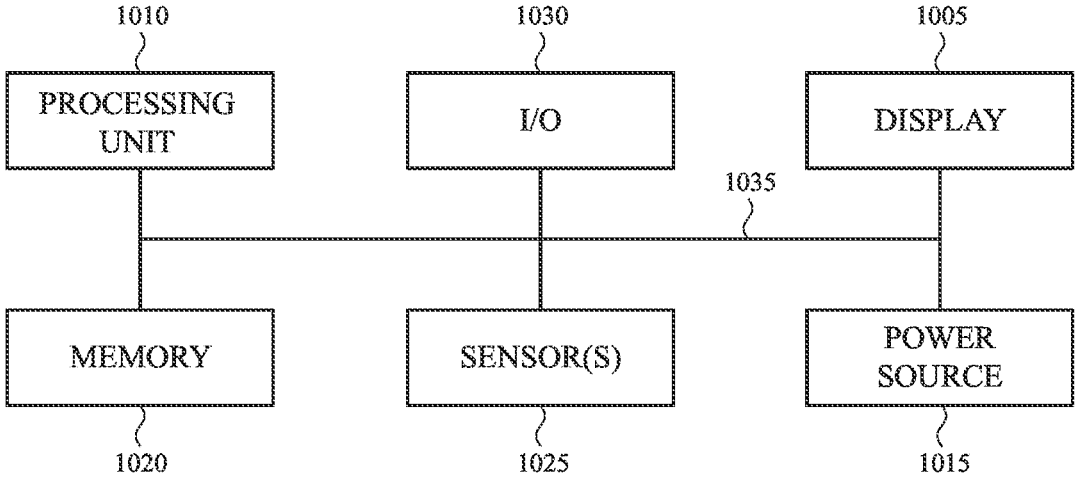
FIG. 10 shows a sample electrical block diagram of an electronic device such as a watch or other wearable electronic device.

FIG. 10 shows a sample electrical block diagram of an electronic device 1000, which electronic device may in some cases take the form of any of the electronic watches or other wearable electronic devices described with reference to FIGS. 1-9, or other portable or wearable electronic devices. The electronic device 1000 can include a display 1005 (e.g., a light-emitting display), a processing unit 1010, a power source 1015, a memory 1020 or storage device, a sensor 1025, and an input/output (I/O) mechanism 1030 (e.g., an input/output device, input/output port, or haptic input/output interface). The processing unit 1010 can control some or all of the operations of the electronic device 1000. The processing unit 1010 can communicate, either directly or indirectly, with some or all of the components of the electronic device 1000. For example, a system bus or other communication mechanism 1035 can provide communication between the processing unit 1010, the power source 1015, the memory 1020, the sensor 1025, and the input/output mechanism 1030.

The processing unit 1010 can be implemented as any electronic device capable of processing, receiving, or transmitting data or instructions. For example, the processing unit 1010 can be a microprocessor, a central processing unit (CPU), an application-specific integrated circuit (ASIC), a digital signal processor (DSP), or combinations of such devices. As described herein, the term "processing unit" is meant to encompass a single processor or processing unit, multiple processors, multiple processing units, or other suitably configured computing element or elements.

It should be noted that the components of the electronic device 1000 can be controlled by multiple processing units. For example, select components of the electronic device 1000 (e.g., a sensor 1025) may be controlled by a first processing unit and other components of the electronic device 1000 (e.g., the display 1005) may be controlled by a second processing unit, where the first and second processing units may or may not be in communication with each other. In some cases, the processing unit 1010 may determine a biological parameter of a user of the electronic device, such as an ECG for the user.

The power source 1015 can be implemented with any device capable of providing energy to the electronic device 1000. For example, the power source 1015 may be one or more batteries or rechargeable batteries. Additionally or alternatively, the power source 1015 can be a power connector or power cord that connects the electronic device 1000 to another power source, such as a wall outlet.

The memory 1020 can store electronic data that can be used by the electronic device 1000. For example, the memory 1020 can store electrical data or content such as, for example, audio and video files, documents and applications, device settings and user preferences, timing signals, control signals, and data structures or databases. The memory 1020 can be configured as any type of memory. By way of example only, the memory 1020 can be implemented as random access memory, read-only memory, Flash memory, removable memory, other types of storage elements, or combinations of such devices.

The electronic device 1000 may also include one or more sensors 1025 positioned almost anywhere on the electronic device 1000. The sensor(s) 1025 can be configured to sense one or more type of parameters, such as but not limited to, pressure, light, touch, heat, movement, relative motion, biometric data (e.g., biological parameters), and so on. For example, the sensor(s) 1025 may include a heat sensor, a position sensor, a light or optical sensor, an accelerometer, a pressure transducer, a gyroscope, a magnetometer, a health monitoring sensor, and so on. Additionally, the one or more sensors 1025 can utilize any suitable sensing technology, including, but not limited to, capacitive, ultrasonic, resistive, optical, ultrasound, piezoelectric, and thermal sensing technology. In some examples, the sensors 1025 may include one or more of the electrodes described herein (e.g., one or more electrodes on an exterior surface of a cover sheet that forms part of a housing for the electronic device 1000 and/or an electrode on a crown, button, or other housing member of the electronic device).

The I/O mechanism 1030 can transmit and/or receive data from a user or another electronic device. An I/O device can include a display, a touch sensing input surface, one or more buttons (e.g., a graphical user interface "home" button), one or more cameras, one or more microphones or speakers, one or more ports such as a microphone port, and/or a keyboard. Additionally or alternatively, an I/O device or port can transmit electronic signals via a communications network, such as a wireless and/or wired network connection. Examples of wireless and wired network connections include, but are not limited to, cellular, Wi-Fi, Bluetooth, IR, and Ethernet connections.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An electronic watch, comprising:
a housing;
a crown assembly comprising:
a crown having a conductive cap; and
a shaft assembly electrically coupled to the conductive cap;
a switch assembly comprising a tactile switch configured to detect an inward press on the crown;
electrical circuitry electrically coupled to the conductive cap through the switch assembly and the shaft assembly; and
a processing unit operably coupled to the electrical circuitry and configured to determine a biological parameter of a user based on a voltage at the conductive cap.

2. The electronic watch of claim 1, wherein:
the crown assembly further comprises an attachment mechanism mechanically and electrically coupling the conductive cap to the shaft assembly;
the shaft assembly defines a recess;
the conductive cap comprises a protrusion extending at least partially into the recess; and
the attachment mechanism comprises:
a conductive bonding material disposed between the conductive cap and the shaft assembly; and
a mechanical interlock formed by the protrusion, the recess, and the conductive bonding material.

3. The electronic watch of claim 2, wherein:
the protrusion comprises an interlock feature;
the recess defines an undercut region; and
the interlock feature cooperates with the undercut region to form the mechanical interlock between the conductive cap and the shaft assembly.

4. The electronic watch of claim 3, wherein the conductive bonding material is a solder that at least partially surrounds the protrusion.

5. The electronic watch of claim 1, wherein:
the conductive cap defines a first electrode of the electronic watch;
the voltage is a first voltage;
the electronic watch further comprises a second electrode positioned along an exterior surface; and
the processing unit is configured to determine the biological parameter of the user based on the first voltage and a second voltage at the second electrode.

6. The electronic watch of claim 1, wherein the crown assembly further comprises:
a crown body at least partially defining a cavity, the conductive cap positioned at least partially in the cavity; and
an intermediate component positioned between the crown body and the conductive cap and electrically isolating the crown body from the conductive cap.

7. The electronic watch of claim 6, wherein:
the conductive cap defines a first portion of an exterior surface of the crown assembly;
the crown body defines a second portion of the exterior surface of the crown assembly; and
the intermediate component forms a third portion of the exterior surface of the crown assembly.

8. An electronic watch, comprising:
a housing defining an opening;
a processing unit disposed within the housing;
a user-rotatable crown comprising:
a crown body; and
a shaft extending through the opening in the housing;
a first electrode positioned at an exterior surface of the electronic watch and configured to detect a first voltage;
a second electrode positioned at an end of the user-rotatable crown and configured to detect a second voltage, the second electrode electrically isolated from the crown body of the user-rotatable crown, wherein:
the processing unit is configured to generate an electrocardiogram using the first voltage and the second voltage.

9. The electronic watch of claim 8, further comprising a switch assembly configured to detect a translation of the user-rotatable crown, wherein the second electrode is conductively coupled to the processing unit through the shaft of the user-rotatable crown and the switch assembly.

10. The electronic watch of claim 8, wherein the second electrode is electrically isolated from the crown body by an isolating component at least partially surrounding the second electrode and defining a portion of an exterior surface of the user-rotatable crown.

11. The electronic watch of claim 10, wherein the crown body is coupled to the shaft.

12. The electronic watch of claim 11, wherein:
the crown body defines a first portion of a cavity;
the shaft defines a second portion of the cavity; and
the user-rotatable crown further comprises a cap defining the second electrode, the cap positioned at least partially within the cavity.

13. The electronic watch of claim 10, wherein the isolating component surrounds at least a portion of the shaft.

14. The electronic watch of claim 13, wherein the isolating component electrically isolates the shaft from the housing.

15. The electronic watch of claim 8, wherein:

the user-rotatable crown further includes a cap defining the second electrode;

the cap defines an interlocking feature;

the shaft defines a recess configured to receive at least a portion of the interlocking feature; and the user-rotatable crown further comprises a conductive bonding material disposed between the interlocking feature and the recess and configured to mechanically and electrically couple the cap to the shaft.

16. A wearable electronic device comprising:

a housing defining an opening;

a crown assembly configured to receive a rotational input and a translational input and comprising:

a crown body;

a shaft mechanically coupled to the crown body and extending through the opening in the housing; and a conductive cap positioned at an end of the crown assembly and mechanically and electrically coupled to the shaft;

a rotation sensor configured to detect a parameter of the rotational input;

a translation sensor configured to detect the translational input; and a processing unit configured to generate an electrocardiogram of a user in response to detecting a voltage at the conductive cap.

17. The wearable electronic device of claim 16, wherein the conductive cap is conductively coupled to the processing unit via a conductive path that includes the shaft.

18. The wearable electronic device of claim 17, wherein:

the translation sensor comprises a dome switch; and the conductive path further includes a portion of the dome switch.

19. The wearable electronic device of claim 16, wherein:

the wearable electronic device further comprises an electrode positioned on a surface of the housing and conductively coupled to the processing unit;

the conductive cap is configured to be contacted by the user of the wearable electronic device while the electrode is positioned against skin of the user; and the processing unit is configured to generate the electrocardiogram based on voltages sensed at the conductive cap and the electrode while the user is in contact with the conductive cap and the electrode.

20. The wearable electronic device of claim 16, further comprising an isolating component positioned between the conductive cap and the crown body and configured to electrically isolate the crown body and the conductive cap.

* * * * *